US006454377B1

(12) United States Patent
Ishizaki

(10) Patent No.: US 6,454,377 B1
(45) Date of Patent: Sep. 24, 2002

(54) DRIVING CIRCUIT FOR INK JET PRINTING HEAD

(75) Inventor: Sunao Ishizaki, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/422,147

(22) Filed: Oct. 20, 1999

(30) Foreign Application Priority Data

Oct. 10, 1998 (JP) ..... 10-318445

(51) Int. Cl.[7] ..... B41J 2/205
(52) U.S. Cl. ..... 347/15; 347/10; 347/68
(58) Field of Search ..... 347/10, 11, 12, 347/15, 40, 43, 14, 62, 61, 68; 358/1.2, 534

(56) References Cited

U.S. PATENT DOCUMENTS 5,198,833 A * 3/1993 Kubota ..... 347/15
5,552,809 A * 9/1996 Hosono et al. ..... 347/10
5,668,579 A 9/1997 Fujii et al.
6,102,513 A * 8/2000 Wen ..... 347/15
6,145,949 A * 11/2000 Takahashi ..... 347/14

FOREIGN PATENT DOCUMENTS

EP 0812689 12/1997
JP 2-164544 6/1990
JP 9-11457 1/1997

* cited by examiner

*Primary Examiner*—John Barlow
*Assistant Examiner*—Lamson Nguyen
(74) *Attorney, Agent, or Firm*—Dickstein, Shapiro, Morin & Oshinsky, LLP.

(57) ABSTRACT

A driving circuit for ink jet head easily configured with inexpensive elements and which, without malfunctioning, generates desired driving waveform signals to drive piezoelectric actuators with a large capacitive load. The driving circuit for ink jet head is provided with a ROM which stores time information and current information for each diameter of ink jet droplets, waveform control circuits which read out the current information from the ROM according to the shape of the corresponding driving waveform signal and output that information as driving waveform data, waveform generating circuits which convert the driving waveform data into analog information and then perform integration operations on that data, to generate driving waveform signals, a data transmission circuit which selects one of the driving waveform signals according to the gradation information of the printing data and applies thus selected signal to the piezoelectric actuators, a data receiving circuit, and transfer gates.

8 Claims, 15 Drawing Sheets

*FIG. 4A*

| n | T | V |
|---|---|---|
| 1 | 0.0 μs | 12.0 V |
| 2 | 4.0 | 7.2 |
| 3 | 5.2 | 7.2 |
| 4 | 14.8 | 31.0 |
| 5 | 31.2 | 31.0 |
| 6 | 77.2 | 12.0 |

*FIG. 4B*

| n | T | V |
|---|---|---|
| 1 | 0.0 μs | 12.0 V |
| 2 | 3.4 | 4.8 |
| 3 | 5.0 | 4.8 |
| 4 | 8.0 | 13.4 |
| 5 | 25.2 | 13.4 |
| 6 | 30.4 | 12.0 |

*FIG. 4C*

| n | T | V |
|---|---|---|
| 1 | 0.0 μs | 12.0 V |
| 2 | 2.0 | 4.2 |
| 3 | 2.7 | 4.2 |
| 4 | 9.0 | 10.3 |
| 5 | 9.5 | 10.3 |
| 6 | 11.0 | 4.2 |
| 7 | 12.6 | 4.2 |
| 8 | 14.1 | 12.0 |

*FIG.8*

| driving waveform data $D_{D1}$ MSB LSB | $I_0$ [mA] | $I_1$ [mA] | $I_2$ [mA] |
|---|---|---|---|
| 0000 0000 | 0 μs | 128/256 | -128/256 |
| 0000 0001 | 1/256 | | -127/256 |
| ⋮ | ⋮ | | ⋮ |
| 0111 1111 | 127/256 | | -1/256 |
| 1000 0000 | 128/256 | | 0/256 |
| 1000 0001 | 129/256 | | +1/256 |
| ⋮ | ⋮ | | ⋮ |
| 1111 1110 | 254/256 | | +126/256 |
| 1111 1111 | 255/256 | | +127/256 |

| gradation information | transfer gate | | |
|---|---|---|---|
| | large-sized droplet | medium-sized droplet | small-sized droplet |
| 0 0 | off | off | off |
| 0 1 | on | off | off |
| 1 0 | off | on | off |
| 1 1 | off | off | on |

DRIVING CIRCUIT FOR INK JET PRINTING HEAD

BACKGROUND OF THE INVENTION

1. Field of the Invention

The present invention relates to a driving circuit for ink jet printing head using piezoelectric actuator to drive an ink jet printing head and more particularly to a driving circuit for ink jet printing head which modulates the diameter of ink droplets ejected from nozzles (droplet-diameter modulation) based on gradation-represented printing data, thereby changing the size of dots formed on printing paper in order to improve the gradation of characters and images.

2. Description of the Related Art

An example of an ink jet head driving circuit which improves by droplet-diameter modulation the gradation of characters and images by changing the size of dots formed on recording paper is disclosed for example in Japanese Laid-Open Patent Application No. Hei9-11457. This ink jet head driving circuit is provided with common waveform generating means which generates four kinds of driving waveform signals $S_3$ through $S_0$ (see (a)–(d) of FIG. 15) which correspond to a total of four cases consisting of three cases where three sizes of dots are formed and one case where no ink is ejected.

One example of this common waveform generating means is disclosed in Japanese Laid-Open patent Application No. Hei2-16544 (Japanese Patent Gazette No. 2689548), the electric configuration of which is shown in FIG. 16. The common waveform generating means is composed of a waveform generating unit 1 and a current amplifier unit 2.

The waveform generating unit 1 roughly is composed of constant current sources 3 and 4 and a capacitor 5. The constant current source is composed of transistors 6 and 7, a resistor 8, and a constant voltage diode 9, while the constant current source is composed of transistors 10 and 11, a resistor 12, and a constant voltage diode 13. When a H-level control signal SA is supplied to the waveform generating unit 1, an electric current flowing from the transistor 6 to the capacitor 5 is forcedly cut off; if another H-level control signal SB is supplied to it, the constant current source 3 charges the capacitor 5; and if another H-level control signal SC is supplied to it, the constant current source 4 discharges the capacitor 5, thereby generating four kinds of driving waveform signals S3 through S0 shown in (a)–(d) of FIG. 15 respectively. The current amplifier unit 2, which is of a single ended push-pull (SEPP) type, roughly is composed of an NPN-type transistor 14 and a PNP-type transistor 15 which are connected in a emitter-follower configuration, with which voltage corresponding to the above-mentioned driving waveform signals $S_3$ through $S_0$ is applied to a plurality of piezoelectric actuators (not shown) connected in parallel at an output terminal 16 without being influenced by the number of these actuators so that these actuators may be charged and discharged.

Thus, as disclosed in the above-mentioned Japanese Laid-Open Patent Application No. Hei9-11457 describes, it is possible to generate the driving waveform signals $S_3$ through $S_0$ shown in FIG. 15 by using the circuit (see FIG. 16) disclosed as one example of the common waveform generating means disclosed in Japanese Patent Gazette No. 2689548. In the waveform generating unit 1 shown in FIG. 16, however, a current which charges the piezoelectric actuator is determined by the resistor 8 and the constant voltage diode 9 which make up the constant current source 3 and a current which discharges the piezoelectric actuator is determined by the resistor 12 and the constant voltage diode 13, so that in order to generate four kinds of driving waveform signals $S_3$ through $S_0$ shown in FIG. 15, it is actually necessary to appropriately switch the values of the resistors 8 and 12 or change the collector voltage of the transistors 7 and 11. This presents a disadvantage of more complicated circuits concerned.

Also, the above-mentioned conventional ink jet head driving circuit, which charges and discharges the capacitor 5 shown in FIG. 16 to generate the driving waveform signals $S_3$ through $S_0$, has high voltage of several tens of volt applied to the capacitor 5 and also needs to be provided with a charging path and a discharging path separately, thus presenting a disadvantage of requiring a number of separate elements which cannot be integrated. Moreover, That driving circuit has a disadvantage of restricted selection of elements because it requires elements with good frequency response to generate driving waveform having a high voltage slew-rate (dV/dt) value.

Also, a preferable mode is one wherein capacitance of 3000 pF each, so that when for example 300 piezoelectric actuators are driven at the same time, the total capacitance amounts to as large as 0.9 $\mu$F. With this, if a simple SEPP type of current amplifier is configured such as shown in FIG. 16, the capacitive load is as large as 0.9 $\mu$F, so that when, moreover, a driving waveform signal with a high voltage slew-rate (dV/dt) is applied, the current amplifier unit 2 may oscillate at around several MHz. In the event of such oscillation, the transistors are excessively heated and may be destroyed, thus presenting another problem.

Also, in the current amplifier unit 2 shown in FIG. 16, even when no printing is performed, that is, when the transistor 15 is in the OFF state, a slight leakage current flows between the collector and the emitter of the transistor 15, so that it is difficult to hold at a constant value the voltage applied to the piezoelectric actuators. Therefore, when the DC voltage is gradually decreased, as shown by a dash-and-dot line in FIG. 7, which is applied to the piezoelectric actuators when ink is ejected from the second time onward, a displacement of the piezoelectric actuators, which is proportional to the voltage, is also decreased, thus disabling the ejection of ink, which presents another problem.

If the DC voltage applied to the piezoelectric actuators is increased gradually, on the other hand, ink may be ejected undesirably, which presents another problem.

SUMMARY OF THE INVENTION

In view of the above, it is an object of the present invention to provide a driving circuit for ink jet printing head that can be easily configured even with inexpensive elements, that does not malfunction, and that can generate desired driving waveform signals to drive piezoelectric actuators with a large capacitive load.

According to an aspect of the present invention, there is provided a driving circuit for ink jet printing head which has at least one nozzle and at least one pressure producing chamber and which, when printing, applies a driving waveform signal to at least one piezoelectric actuator provided at position corresponding to the pressure producing chamber to rapidly change a volume of the pressure producing chamber filled with ink, thereby ejecting ink droplets from the nozzle, further including:

storage means for storing driving waveform information about driving waveform signals for each diameter of the ink droplets; a plurality of waveform control means which is provided for each diameter of the ink droplets and which reads out the driving waveform information according to a waveform of corresponding driving waveform signals and then sequentially output the driving waveform information;

a plurality of waveform generating means which is provided for each diameter of the ink droplets, for generating a corresponding driving waveform signal by converting driving waveform information provided sequentially from the waveform control means into analog information and then conducting integration operation on the analog information; and driving means which selects one driving waveform signal of a plurality of driving waveform signals output from the plurality of waveform generating means and applies the one driving waveform signal to the piezoelectric actuator.

In the foregoing, a preferable mode is one wherein the driving waveform information has time information about time of change point of corresponding driving waveform signals and voltage information about voltage of the change point or current information which is a differential value of the voltage information in terms of time; and each waveform control means sequentially outputs the voltage information or the current information according to the time information.

Also, a preferable mode is one wherein each waveform generating means has a digital/analog converter which converts the voltage information or the current information into an analog signal, an integrator which has an operational amplifier and an integrating capacitor to perform integration operations on the analog signal, a negative feed-back unit which gives a negative feed-back to the operational amplifier so as to hold an output voltage of the waveform generating means to a zero potential before stating of and after termination of printing and to a prescribed bias potential which provides a reference of contraction and expansion of the piezoelectric actuator at time point of not printing during printing operations, and a negative feed-back cut-off unit which cuts off the negative feed-back to ground a positive input terminal of the operational amplifier.

Also, a preferable mode is one that wherein further having a plurality of power amplification means which is provided for each diameter of the ink droplets, for power-amplifying driving waveform signals output from corresponding waveform generating means and supplying the signal to the driving means, wherein each power amplification means has a differential amplification means which differential-amplifies corresponding driving waveform signals, a voltage amplification unit which voltage-amplifies an output signal of the differential amplification unit, a single-ended push-pull type current amplification unit which current-amplifies an output signal of the voltage amplification unit, and a negative feedback unit which gives a negative feed-back to the differential amplification unit from the current amplification unit.

Also, a preferable mode is one wherein the driving means has a data transmission unit, a data receiving unit, and a plurality of transfer gates provided for each diameter of the ink droplets for each piezoelectric actuator;

the data transmission unit sends at least gradation information of printing data to the data receiving unit; and the data receiving unit is provided together with the plurality of transfer gates near the piezoelectric actuators, to turn corresponding transfer gates ON or OFF based on gradation information sent from the data transmission unit.

Also, a preferable mode is one wherein at least the plurality of waveform control means and the data transmission unit are integrated into one unit.

Furthermore, a preferable mode is one wherein a temperature sensor is provided near the piezoelectric actuator;

the storage means stores driving waveform information for each diameter of the ink droplets for each temperature of the piezoelectric actuator; and each waveform control means reads out the driving waveform information from the storage means based on a temperature signal sent from the temperature sensor.

With the above construction, it is possible to configure circuits easily and with inexpensive elements and also to generate desired driving waveform signals which drive piezoelectric actuators with a large capacitive load.

Also, it is possible to eject ink droplets in a stable manner irrespective of changes in the viscosity of ink due to changes in the temperature of the ink jet printing heads.

BRIEF DESCRIPTION OF THE DRAWINGS

The above and other objects, advantages, and features of the present invention will be more apparent from the following description taken in conjunction with the accompanying drawings in which:

FIGS. 4A, 4B and 4C are tables showing examples of time information pieces $T_1$–$T_6$ and voltage information pieces $V_1$–$V_6$ of the same driving waveform signals $D_{D1}$–$SD_{D3}$;

FIG. 8 is a table for showing an example of a relationship among values of driving waveform data $D_{D1}$, an output current $I_O$ of a digital/analog converter DAC, and a current $I_2$ flowing through a capacitor C1 according to the same configuration as above;

DETAILED DESCRIPTION OF THE PREFERRED EMBODIMENTS

Best modes for carrying out the present invention will be described in further detail using various embodiments with reference to the accompanying drawings.

Figure 2A:
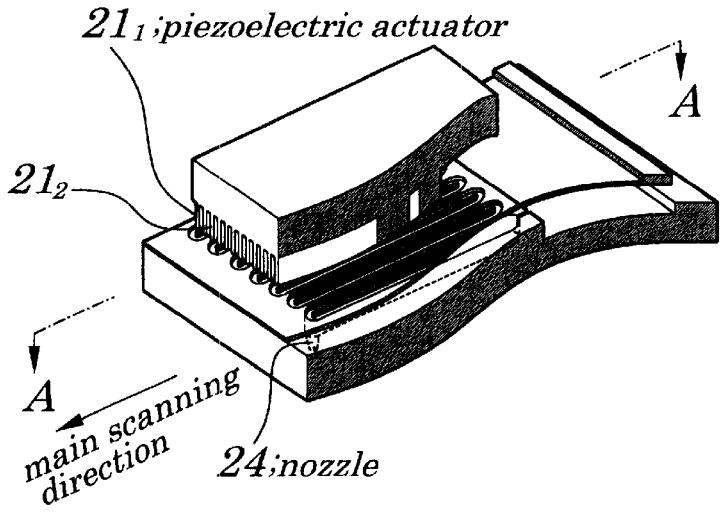
FIG. 2A is a schematic perspective view for showing a mechanical configuration of the same ink jet head as above.
Figure 2B:
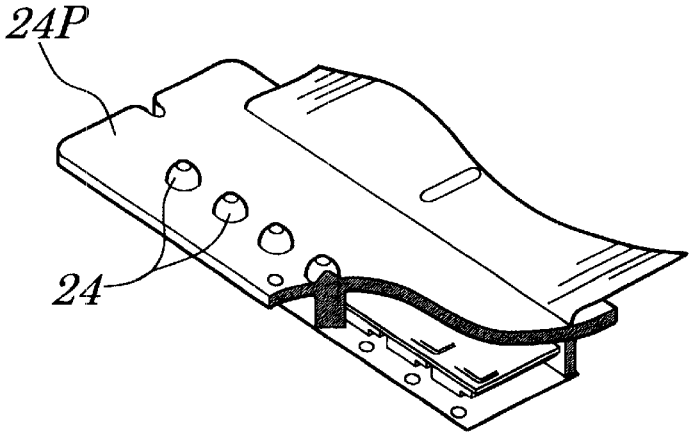
FIG. 2B is a: rear perspective view showing the same ink jet head as above.
Figure 2C:
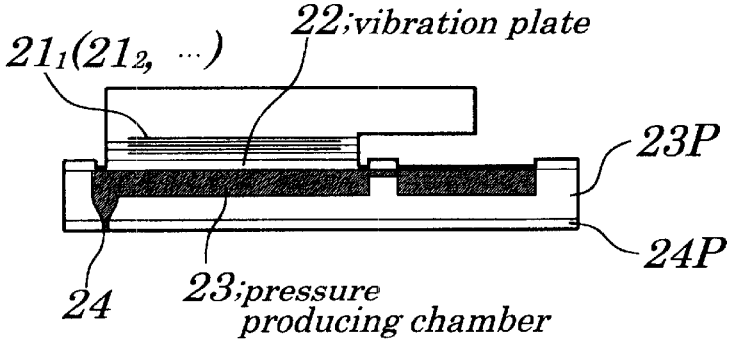
FIG. 2C is a cross-sectional view taken along line A—A shown in FIG. 2A.

As shown in FIGS. 2A, 2B and 2C, the ink jet head given in this embodiment has a stacked-layer configuration which has: a nozzle plate 24P which has in it a plurality of nozzles (orifices) 24; a pressure producing chamber plate 23P which has in recess a plurality of pressure producing chambers 23 which correspond in a one-to-one relationship to the nozzles 24; a plurality vibration plates 22 forming a ceiling board of each pressure producing chamber 23 shown in FIG. 2C which correspond in a one-to-one relationship to the pressure producing chambers 23; and a plurality of piezoelectric actuators adhered the vibration plates 22 in a one-to-one relationship, in which configuration, when driving waveform signals according to printing data are applied to a given combination of these piezoelectric actuators $\mathbf{21}_1$, $\mathbf{21}_2$, . . . , the corresponding vibration plates 22 are displaced to rapidly change the volume of the pressure producing chambers 23 filled with ink, thus ejecting desired ink from the corresponding nozzles 24 of the nozzle head, which is called a drop-on-demand type multi-nozzle head, more specifically a Kyser type head.

The ink jet printer is mounted with a plurality of ink jet heads of the above-mentioned configuration, thus having in all approximately 300 piezoelectric actuators $\mathbf{21}_1$, $\mathbf{21}_2$, . . . in an array. Note here that in this embodiment, the configuration is so designed that the piezoelectric actuators $\mathbf{21}_1$, $\mathbf{21}_2$, . . . each have an electrostatic capacitance of about 3000 pF and a maximum displacement of about 0.2 $\mu$m. This type of ink jet head performs printing of 32 dots for each printing row for each of a total of four colors of yellow (Y), magenta (M), cyan (C), and black (K) The ink jet head driving circuit shown in FIG. 1 has a configuration that is roughly provided with: a CPU(Central Processing Unit) 31; a ROM 32; a RAM 33; an interface 34; waveform control circuits 36*a*–36*c;* a data transmission circuit 37; waveform generating circuits 38*a*–38*c;* power amplification circuits 39*a*–39*c;* a data receiving circuit 40; and transfer gates $\mathbf{41}_{1a}$–$\mathbf{41}_{1c}$, $\mathbf{41}_{2a}$–$\mathbf{41}_{2c}$, . . . , in which that driving circuit generates three kinds of driving waveform signals $S_{D1}$–$S_{D3}$ (see FIGS. 3A–3C) and amplifies their power and then supplies them to the piezoelectric actuators $\mathbf{21}_1$, $\mathbf{21}_2$, . . . , in order to drive the above-mentioned ink jet head in such a way that the diameter of ink droplets ejected from each nozzle 24 may change in four steps of a large-sized flying droplet with a diameter of about 40 $\mu$m, a medium-sized flying droplet with a diameter of about 30 $\mu$m, a small-sized flying droplet with a diameter of 30 $\mu$m, and no droplet being ejected, thus printing characters and images on recording paper in four gradations.

The CPU 31 executes programs stored in the ROM 32 and uses various registers and flags preserved in the RAM 33, to control various units of the system in order to perform color-printing of characters and images on recording paper in four gradations based on the droplet-diameter modulated printing data supplied from such higher-order apparatuses as a personal computer via the interface 34.

The above-mentioned printing data is given in 32-dot units for each row and for each of a total of four colors of yellow (Y), magenta (M), cyan (C), and black (K) and also given as much as two bits for each dot to accommodate the four-gradation specifications and, therefore, is supplied as parallel printing data of $D_{PY}$, $D_{PM}$, $D_{PC}$, and $D_{PK}$ with 32×2=64 bits for each row and for each color via the interface 34 as a unitary printing amount for each row and then stored once in prescribed registers of the RAM 33.

In the prescribed storage area of the ROM 32 is stored beforehand the driving waveform information which has time information pieces $T_1$–$T_6$, $T_1$–$T_6$, and $T_1$–$T_6$ and electric current information pieces $I_1$–$I_6$, $I_1$–$I_6$, and $I_1$–$I_6$ for the driving waveform signals $S_{D1}$–$S_{D3}$ which accommodate large-sized, medium-sized and small-sized droplets respectively.

Figure 3A:
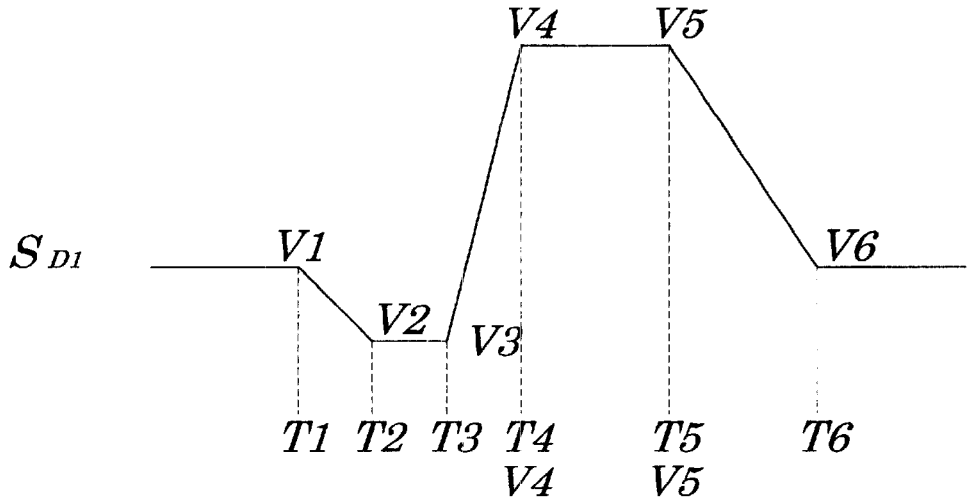
FIGS. 3A, 3B and 3C are waveform charts of driving waveform signals $D_{D1}$–$S_{D3}$ according to the same embodiment as above.
Figure 3B:
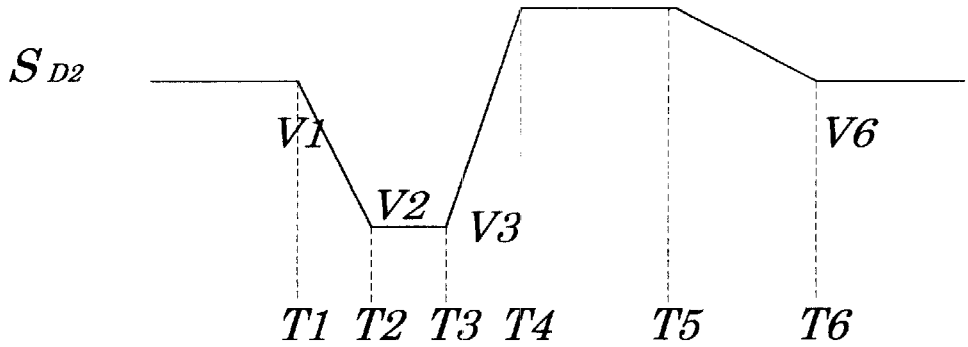
Figure 3C:
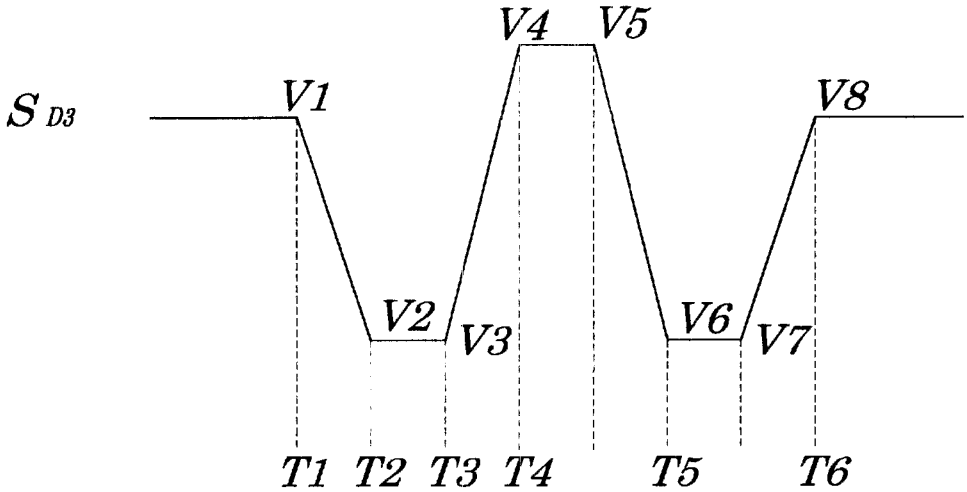

FIGS. 4A–4C show voltage information pieces $V_1$–$V_6$, $V_1$–$V_6$, and $V_1$–$V_6$ which provide a basis for the time information pieces $T_1$–$T_6$, $T_1$–$T_6$, and $T_1$–$T_6$ and the current information pieces $I_1$–$I_6$, $I_1$–$I_6$, and $I_1$–$I_6$ of the driving waveform signals $S_{D1}$–$S_{D3}$ shown in FIGS. 3A–3C respectively.

The current information pieces $I_1$–$I_6$, $I_1$–$I_6$, and $I_1$–$I_6$ are values (dV/dt) obtained by differentiating in terms of time the voltage information pieces $V_1$–$V_6$, $V_1$–$V_6$, and $V_1$–$V_6$.

Also, in the prescribed storage area of the ROM 32 are stored beforehand the charge information for charging the piezoelectric actuators from a zero potential to a bias potential VB at the time of printing initiation or spacing actuation and the discharge information for discharging them from the bias potential $V_B$ to a zero potential at the time of printing termination or spacing termination.

The bias potential $V_B$ referred to here means a reference potential applied to the piezoelectric actuators when contracted or expanded. The above-mentioned time information pieces $T_1$–$T_6$, $T_1$–$T_6$, $T_1$–$T_6$ and current information pieces $I_1$–$I_6$, $I_1$–$I_6$, and $I_1$–$I_6$, and charge and discharge information pieces are all 8-bit digital data.

The waveform control circuits 36*a* through 36*c* and the data transmission circuit 37 are integrated into one unit as a gate array, which is a kind of Application-Specific Integrated Circuits (ASICs)

Figure 5:
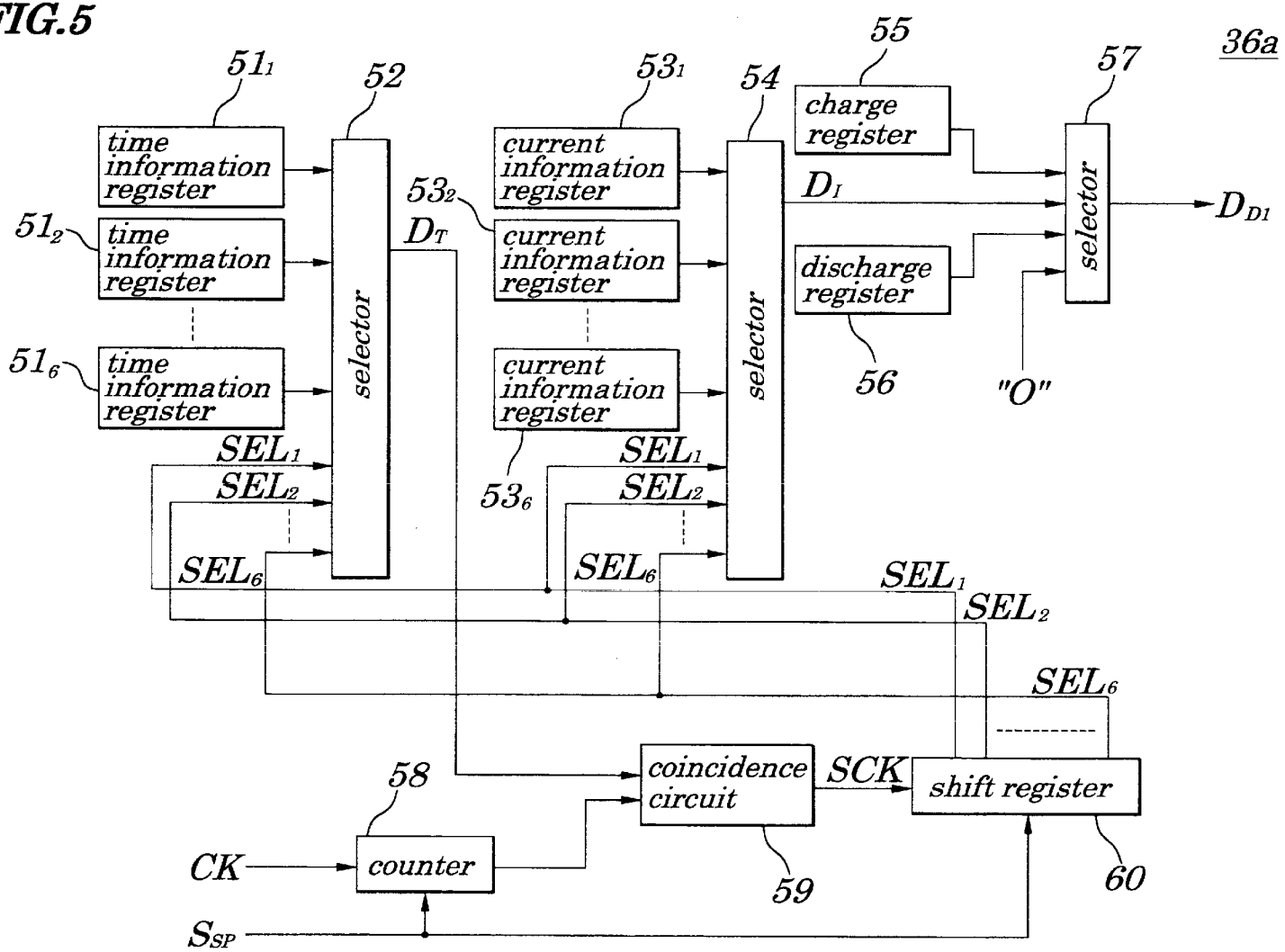
FIG. 5 is a schematic block diagram showing an electrical configuration of a waveform control circuit configuring the same driving circuit as above.

The waveform control circuit 36*a* as shown in FIG. 5, generates driving waveform data $D_{D1}$ in the case where the diameter of ink droplets is large, by a configuration which has time information registers $\mathbf{51}_1$through $\mathbf{51}_6$, selectors 52, 54, and 57, current information registers $\mathbf{53}_1$ through $\mathbf{53}_6$, a charge register 55, a discharge register 56, a counter 58, a coincidence circuit 59, and a shift register 60.

The time information registers $\mathbf{51}_1$–$\mathbf{51}_6$ temporarily store the time information pieces $T_1$–$T_6$ for the driving waveform signal $S_{D1}$ read out by the CPU 31 from a prescribed storage area of the ROM 32. The selector 52 selects one of the time information pieces $T_1$–$T_6$ supplied from the time information registers $\mathbf{51}_1$–$\mathbf{51}_6$, based on Select signals $SEL_1$–$SEL_6$ supplied from the shift register 60, and then provides it as time data $D_T$.

The current information registers $53_1$–$53_6$ temporarily store the time information $I_1$–$I_6$ for the driving waveform signal $S_{D1}$ read out by the CPU 31 from the ROM 32.

The selector 54 selects one of the time information pieces $I_1$–$I_6$ supplied from the current information registers $53_1$–$53_6$, based on the Select signals $SEL_1$–$SEL_6$, and then provides it as time data $D_I$.

The charge register 55 and the discharge register 56 temporarily store charge information and discharge information respectively read out by the CPU 31 from the prescribed storage area of the ROM 32.

The selector 57, based on the Selector signals supplied from the CPU 31, selects charge information supplied from the charge register 55 at the time of printing initiation and, during printing, selects current data DI supplied from the selector 54 and, at the time of printing termination, selects discharge information supplied from the discharge register 56 and also, at the time of holding zero potential and the bias potential, selects 0 and then provides it as the driving waveform data $D_{D1}$.

The counter 58 is reset by the spacing signal $S_{SP}$ which indicates a position in the main scanning direction (see FIG. 2A) of the ink jet head, to count the number of the system clock signal CK pulses.

The spacing signal $S_{SP}$ is obtained as corresponds to a pitch when an optical sensor detects a slit by moving the ink jet head in the main scanning direction, wherein for example the optical sensor is mounted to the ink jet head and, at the same time, a band-shaped film having in it slits at a prescribed pitch (e.g., 1/400 inch) is provided on a surface opposed to the ink jet head.

The coincidence circuit 59 compares one of the time information pieces T1–T6 supplied from the selector 52 to a count value supplied from the counter 58 and, if detects a match, provides a shift clock signal SCK having the same pulse width as the system clock signal CK.

The shift register 60, when supplied with the spacing signal $S_{SP}$, has bit 0 set to 1 and bits 1–5 set to 0, so that it is synchronized with the shift clock signal SCK supplied from the coincidence circuit 59 to shift internal data by each bit to the high-order bit side and then the data of bits 0 through 5 as the Select signals $SEL_1$–$SEL_6$.

The description of the configuration of the waveform control circuits $36_b$ and 36*c* is omitted because that configuration is the same as that of the above-mentioned waveform control circuit $36_a$ except that the driving waveform data generated is, respectively, driving waveform data D for a medium-sized ink droplet diameter and driving waveform data $D_{D3}$ for a small-sized ink droplet diameter.

As shown in FIG. 3C, however, the driving waveform signal $S_{D3}$ has eight change points and correspondingly eight time information pieces and eight current information pieces. The waveform control circuit $36_C$, therefore, has eight time information registers 51, eight current information registers 53, and eight Select signals SEL, with the selectors 52 and 54 each having eight inputs and the shift register 60 being of an eight-bit configuration.

Figure 6:
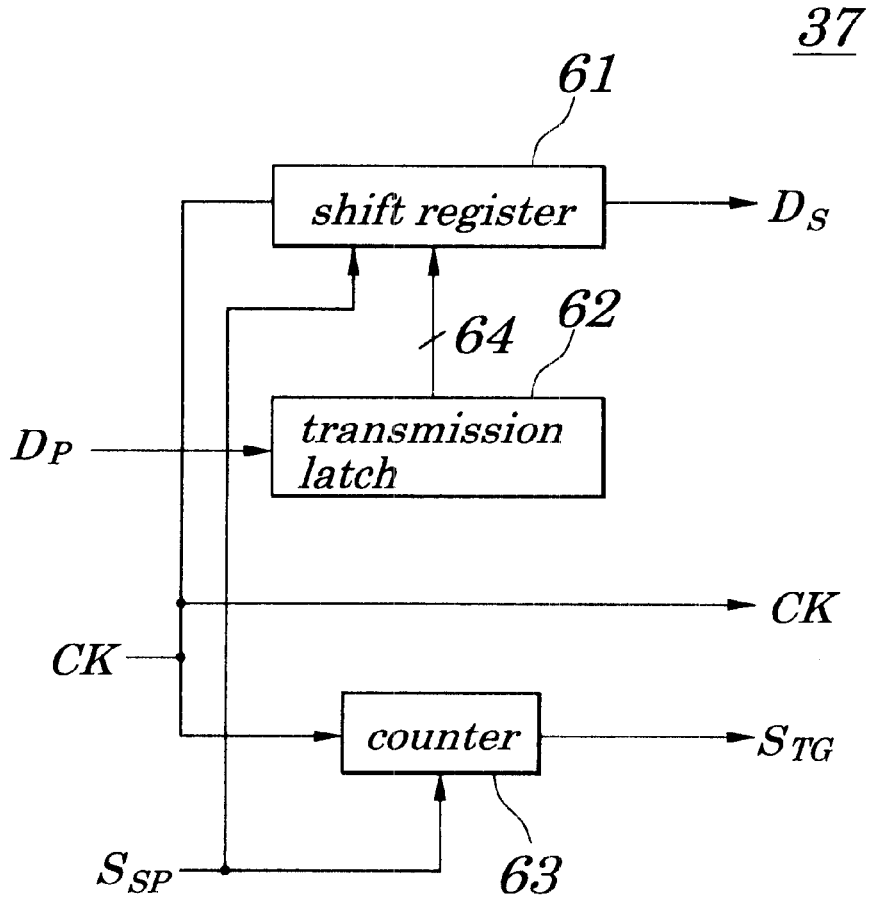
FIG. 6 is a schematic block diagram showing an electrical configuration of a data transmission circuit configuring the same driving circuit as above.

FIG. 6 is a block diagram illustrating the electrical configuration of the data transmission circuit 37.

The data transmission circuit which is composed of a shift register 61, a transmission latch 62, and a counter 63, as shown in FIG. 6, is used to convert 64-bit parallel printing data $D_P$ for yellow (Y), magenta (M), cyan (C), and black (K) into serial printing data $D_S$ and send it to a data receiving circuit 40.

The transmission latch 62 temporarily stores 64-bit parallel printing data $D_P$ read out by the CPU 31 from the RAM 33.

The shift register 61, when supplied with the spacing signal $S_{SP}$, is loaded with 64-bit parallel printing data $D_P$ temporarily stored in the transmission latch 62 and synchronized with the system lock signal CK to shift internal data by each bit to the high-order bit side and then provides it as serial printing data DS. The counter 63 is reset by the spacing signal $S_{SP}$ to count the number of the system clock signal CK pulses and, if the count value reaches 64, provides a trigger signal $S_{TG}$.

The waveform generating circuit 38*a* is composed of a digital/analog converter circuit 71*a* and an integrating circuit 72*a*, to convert driving waveform data $D_{D1}$ into analog data and integrate it to generate driving waveform signal $S_{D1}$; the waveform generating circuit 38*b* s provided with a digital/analog converter circuit 71*b* and an integrating circuit 72*b*, to convert driving waveform data $D_{D2}$ into analog data and integrate it to generate driving waveform signal $S_{D2}$; the waveform generating circuit 38*c* s provided with a digital/analog converter circuit 71*c* and an integrating circuit 72*c*, to convert driving waveform data $D_{D3}$ into analog data and integrate it to generate driving waveform signal $S_{D3}$.

Figure 7:
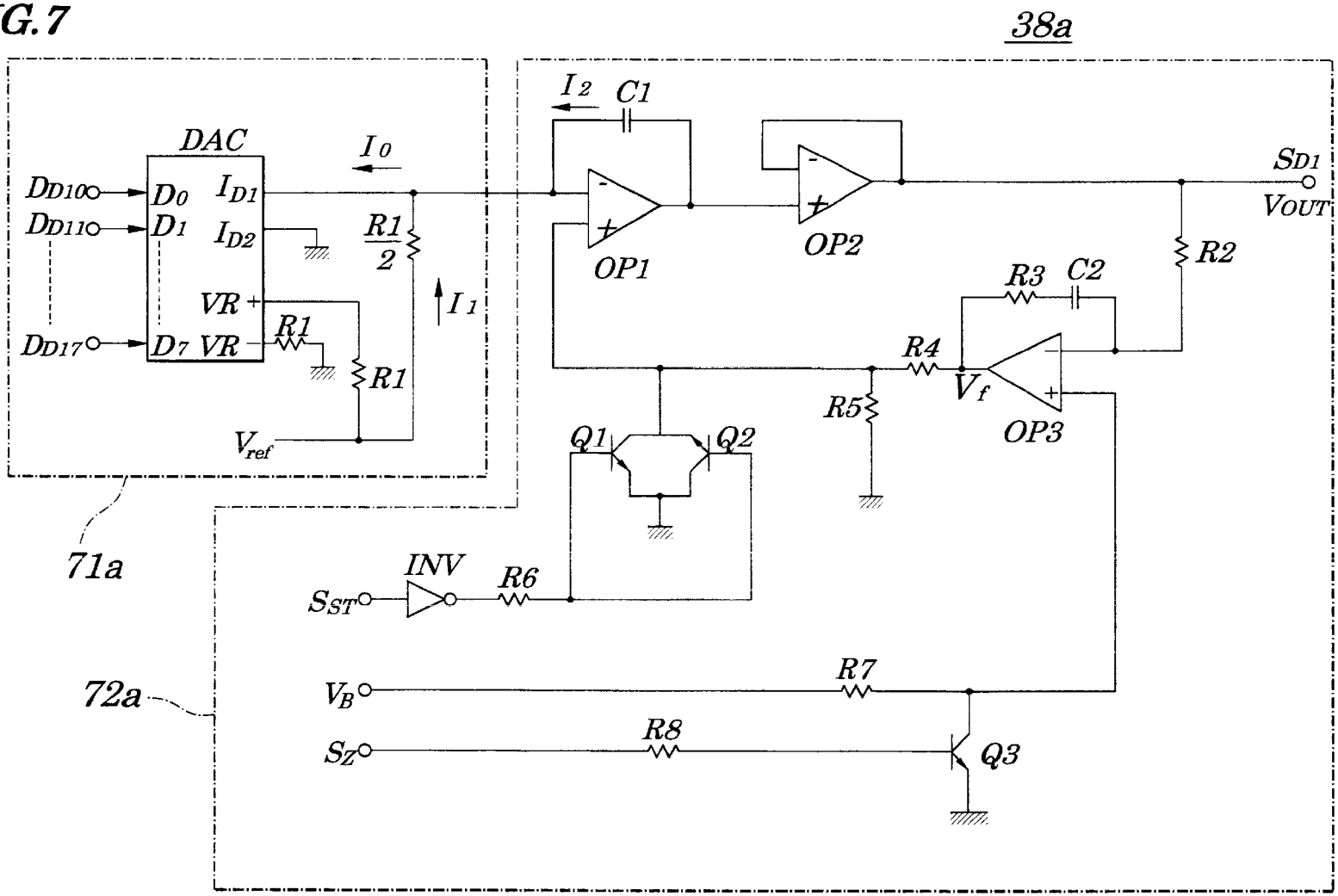
FIG. 7 is a schematic block diagram showing an electrical configuration of a waveform generating circuit configuring the same driving circuit as above.

As shown in FIG. 7, the digital/analog converter circuit 71*a* has a current-output type digital/analog converter DAC with an 8-bit resolution and resistors R1, R1, and R1/2.

The dynamic range of the digital/analog converter DAC is determined by the resistors R1, R1, and R1/2. The integrating circuit 72*c* is composed of operational amplifiers OP1–OP3, transistors Q1–Q3, capacitors C1 and C2, resistors R2–R7, and an inverter INV. The operational amplifier OP1 functions as a current/voltage converter which converts a change in the output current $I_O$ of the digital/analog converter DAC into a change in voltage and also functions as an integrator which performs integration operations using the capacitor C1 as a negative feed-back capacitor.

The operational amplifier OP2 functions as a buffer for impedance conversion to prevent current leakage from the capacitor C1*a*, to provide its own output voltage $V_{OUT}$ as the driving waveform signal $S_{D1}$.

The operational amplifier OP3, the resistors R2–R5, and the capacitor C2 function, when no printing is performed, to provide a negative feed-back to the operational amplifier OP1 in such a way as to hold the output voltage $V_{OUT}$ of the operational amplifier OP2 at a bias potential or a zero potential applied via the resistor R7 to a positive input terminal of the operational amplifier OP3.

In this case, resistors R2 and R3 and the capacitor C2 are used to regulate the time required to shift the output voltage of the operational amplifier OP2 to the bias potential $V_B$ or zero potential.

Transistors Q1 and Q2, when supplied with the L-level of an integration stop signal $S_{ST}$ via the inverter INV and the resistor R6, are turned ON to cut off a negative feed-back loop made up by the operational amplifier OP3 etc. to ground the positive input terminal of the operational amplifier OP1, thus permitting the operational amplifier OP1 to perform integration operations.

A transistor Q3 is turned ON by the H-level of a zero-potential hold signal $S_Z$ supplied via a resistor R8, to ground the positive input terminal of the operational amplifier OP3 in order to hold the output voltage $V_{OUT}$ of the operational amplifier OP2 and, when turned OFF by the L-level of the zero-potential hold signal $S_Z$, applies the bias potential $V_B$ to the positive input terminal of the operational amplifier OP3 in order to hold the output voltage $V_{OUT}$ of the operational amplifier OP3 at the bias potential $V_B$.

FIG. 8 is table which shows the relationship among the values of the driving waveform data $D_{D1}$, the output current $I_O$ [mA] of the digital/analog converter DAC, the current $I_2$ [mA] flowing through the capacitor C1 where the reference voltage is set at 10 [V] and the resistor R1 is set at 10 [kΩ].

Supposing here that the output voltage of the operational amplifier at the time of charge initiation to be output voltage $V_{OUT1}$, that at the time of charge termination to be output voltage $V_{OUT2}$, the charge time to be time $T_1$, and the charge current (output current $I_O$ of the DAC shown in FIG. 7) to be current $I_1$, the output voltage $V_{OUT1}$ is given Equation (1) as follows:

$$V_{OUT2}=V_{OUT1}+(1/C1)\times I_1\times T_1 \quad (1)$$

where C1 represents the capacitance of the capacitor C1 shown in FIG. 7.

The description of the configuration of the waveform generating circuits 38*b* and 38*c* is omitted here because that configuration is the same as that of the above-mentioned waveform generating circuit 38*a* except that the driving waveform data to be converted into analog data for the subsequent integration processing is 8-bit driving waveform data $D_{D2}$ and $D_{D3}$ respectively supplied from the waveform control circuits 36*b* and 36*c*.

Figure 9:
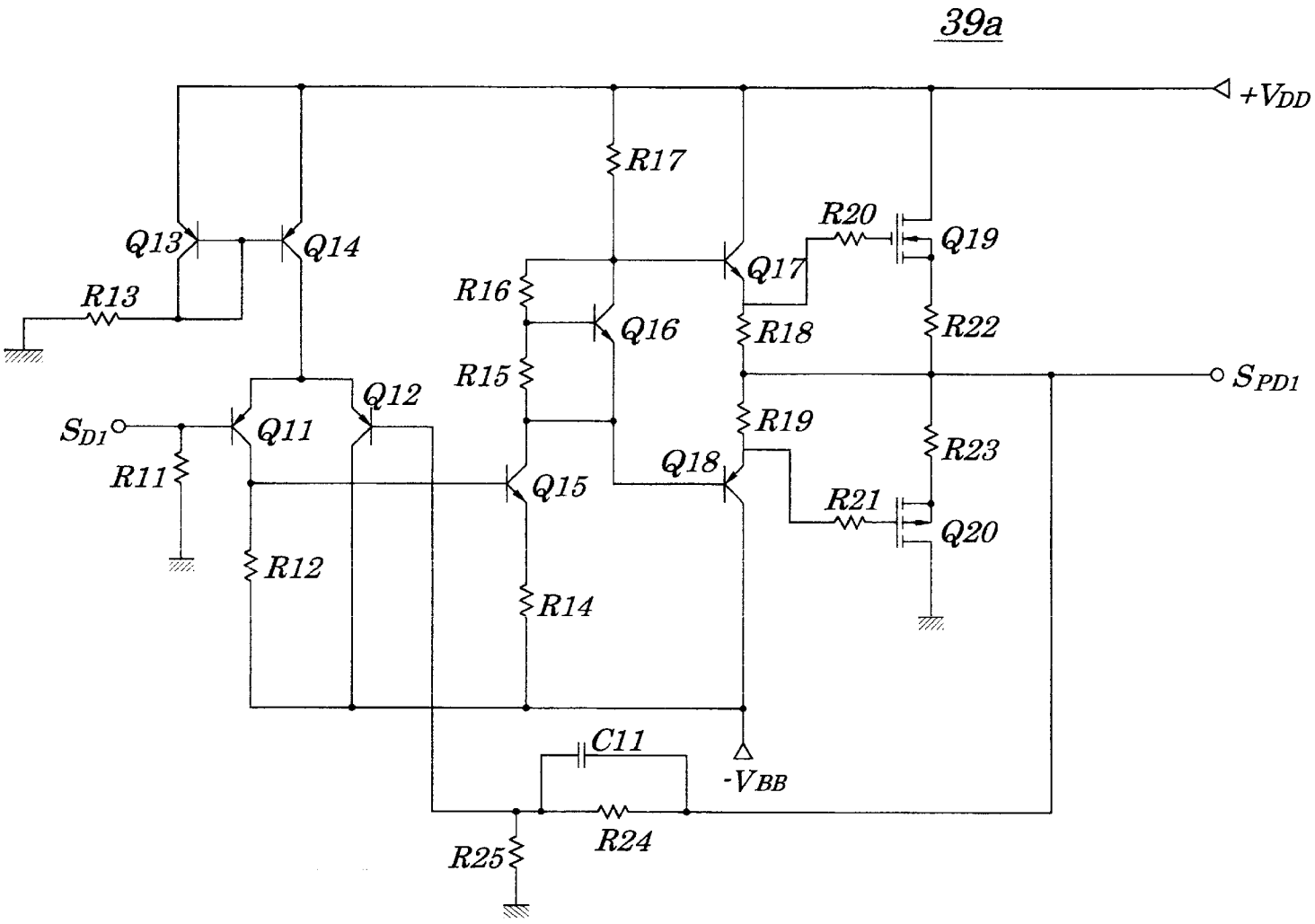
FIG. 9 is a circuit diagram showing an electrical configuration of a power amplifier configuring the same driving circuit as above.

As shown in FIG. 9, the power amplification circuit 39*a* is constituted of transistors Q11–Q20, resistors R11–R25, and a capacitor C11, to amplify in terms of both voltage and current the driving waveform signal $S_{D1}$ supplied from the waveform generating circuit 38*a* and then provide it as an amplified driving waveform signal $S_{PD1}$.

The transistors Q1 and Q2 and the resistors R11 and R12 are combined to configure a differential amplifier to differential-amplify the driving waveform signal $S_{D1}$ supplied from the waveform generating circuit 38*a*.

The transistors Q13 and 14 and the resistor R13 are combined to function as a constant current source for the above-mentioned differential amplifier.

The transistor Q15 and the resistor 14 are combined to function as a voltage amplifier to amplify the voltage of the output signal of the above-mentioned differential amplifier.

The transistor Q16 and the resistors R15–R17 are combined to a bias-voltage generator to generate the bias voltage for driving a current amplifier described later. The transistors Q17 and Q18 and the resistors R18 and R19 are combined to functions as a buffer because the output impedance of the above-mentioned voltage amplifier circuit is high.

The transistors Q19 and Q20, which are of a MOSFET type, are combined with the resistors R20–23, to function as a SEPP-type current amplifier connected in a source-follower configuration. The resistors R24 and R25 and the capacitor C11 are combined to configure a negative feedback circuit n a direction from the current amplifier to the differential amplifier.

The voltage amplification factor $A_V$ by this power amplification circuit 39*a* is give by Equation (2) as follows:

$$A_V=1+R24/R25 \quad (2)$$

The description of the configuration of the power amplification circuits 39*b* and 39*c* is omitted here because that configuration is the same as that of the above-mentioned power amplification circuit 39*a* except that the driving waveform signals to be amplified in terms of power are driving waveform signals $S_{D2}$ and $S_{D3}$ supplied respectively from the waveform generating circuits 38*b* and 38*c*.

Figures 10, 11:
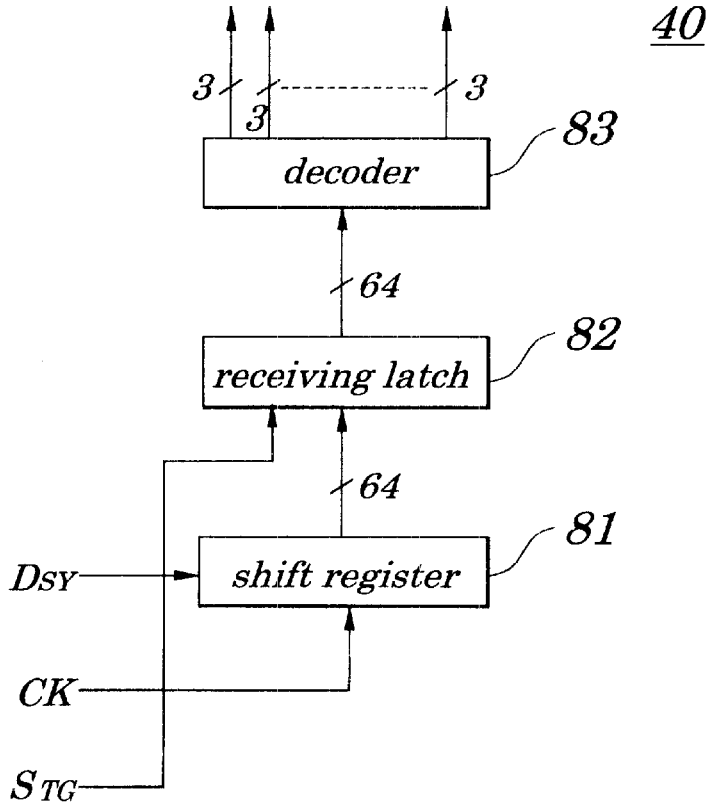
FIG. 10 is a schematic block diagram showing an electrical configuration of a data receiving circuit configuring the same driving circuit as above.
FIG. 11 is a view showing an example of a truth table used by a decoder configuring the data receiving circuit configuring the same driving circuit as above.

FIG. 10 is a block diagram illustrating the electrical configuration of the data receiving circuit 40. The data receiving circuit 40 is composed of a shift register 81, a data receiving latch 82, and a decoder 83, to decode serial printing data DS for yellow (Y), magenta (M), cyan (C), and black (K) sent from the data transmission circuit 37 in order to control transfer gates $\mathbf{41}_{1a}$–$\mathbf{41}_{1c}$, $\mathbf{41}_{2a}$–$\mathbf{41}_{2c}$, . . . The shift register 81 is synchronized with the system clock signal CK, to shift by each bit the serial printing data $D_S$ sent from the data transmission circuit 37 to the high-order bit side for subsequent inputting.

The receiving latch 82, when supplied with the spacing signal $S_{SP}$, is loaded with the 64-bit parallel printing data temporarily held in the shift register 81 and hold it temporarily.

The decoder 83 is decodes the 64-bit parallel printing data temporarily held in the receiving latch based on a truth table shown in FIG. 11, to provide a control signal to control the transfer gates $\mathbf{41}_{1a}$–$\mathbf{41}_{1c}$, $\mathbf{41}_{2a}$–$\mathbf{41}_{2c}$, . . .

The transfer gates $\mathbf{41}_{1a}$–$\mathbf{41}_{1c}$, $\mathbf{41}_{2a}$–$\mathbf{41}_{2c}$, . . . are configured in such a way that their p-channel MOSFETs and n-channel MOSFETs are interconnected at their drain terminals and source terminals respectively. Of these, the transfer gates $\mathbf{41}_{1a}$, $\mathbf{41}_{2a}$, . . . have their first input/output terminals commonly connected to the output terminal of the power amplification circuit 39*a* and their second input/output terminals each connected to one terminal of the piezoelectric actuators $\mathbf{21}_1$, $\mathbf{21}_2$, . . . respectively and also their control terminals commonly provided with a corresponding control signal provided from the data receiving circuit 40.

Similarly, the transfer gates $\mathbf{41}_{1b}$, $\mathbf{41}_{2b}$, . . . have their first input/output terminals commonly connected to the output terminal of the power amplification circuit 39*b* and their second input/output terminals each connected to one terminal of the piezoelectric actuators $\mathbf{21}_1$, $\mathbf{21}_2$, . . . respectively and also their control terminals commonly provided with another corresponding control signal.

The transfer gates $\mathbf{41}_{1c}$, $\mathbf{41}_{2c}$, . . . have their first input/output terminals commonly connected to the output terminal of the power amplification circuit 39*c* and their second input/output terminals respectively connected to one terminal of the piezoelectric actuators $\mathbf{21}_1$, $\mathbf{21}_2$, . . . and also their control terminals provided with the corresponding control signal output from the data receiving circuit 40.

The other terminals of the piezoelectric actuators $\mathbf{21}_1$, $\mathbf{21}_2$, . . . are all grounded. Next, the following will describe how the driving circuit of the above-mentioned configuration operates.

Figure 12:
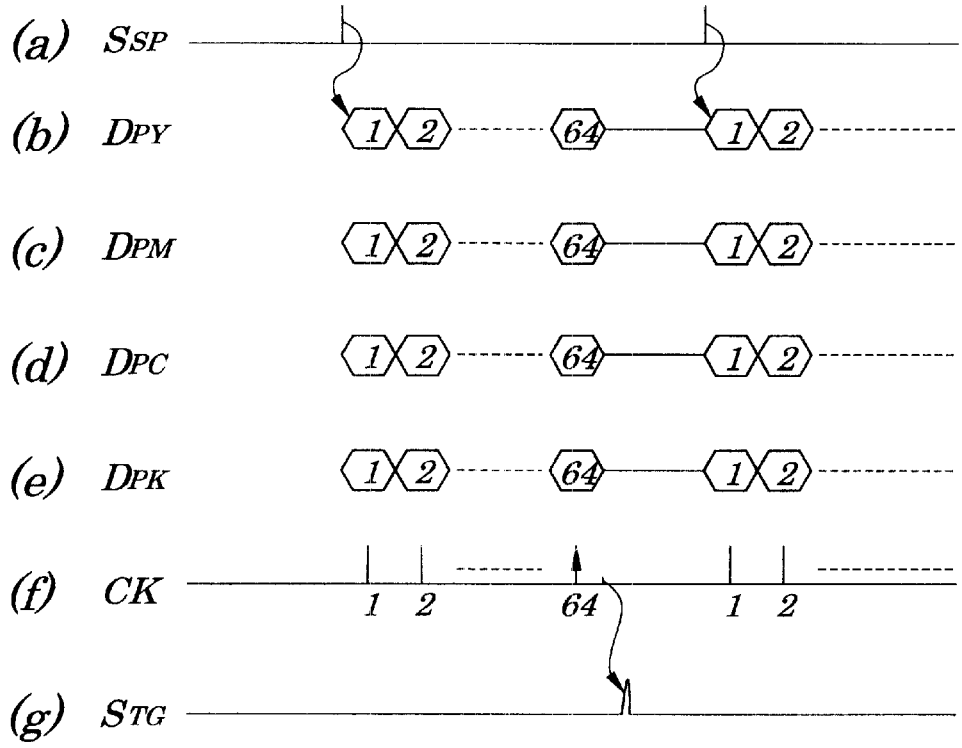
FIG. 12 is a timing chart for explaining operations of the same data transmission circuit as above.

First, the operations of the data transmission circuit 37 and the data receiving circuit 40 are described with reference to FIGS. 10–12.

When the CPU 31 reads out 64-bit parallel printing data $D_P$ about yellow (Y), magenta (M), cyan (C), and black (K) and supplies it to the data transmission circuit 37 shown in FIG. 6, the printing data DP is temporarily held in the transmission latch 62. Then, when the spacing signal $S_{SP}$ is supplied to it as shown in (a) of FIG. 12, the shift register 61 is loaded with the printing data $D_P$ temporarily stored in the transmission latch 62.

With this, the shift register 61 is synchronized with the system clock signal CK as shown in (a)–(g) of FIG. 12, to shift the internal data by each bit to the higher-order bit side to provide it as serial printing data $D_S$, which is subsequently sent to the data receiving circuit 40.

Then, when the printing data $D_S$ is output, the counter 63 provides thew trigger signal $S_{TG}$ as it counts 64.

In the data receiving circuit 40 shown in FIG. 10, the shift register 81 is synchronized with the system clock signal CK to shift by each bit the printing data $D_S$ sent from the data transmission circuit 37, to the higher-order bit side for inputting.

When the printing data $D_S$ is input into the shift register as much as 64 bits, the spacing signal $S_{SP}$ is supplied, to permit the receiving latch to be loaded with 64-bit parallel printing data DP temporarily held in the shift register 81 and holds it temporarily.

With this, the decoder 83 decodes the 64-bit parallel printing data $D_P$ temporarily held in the receiving latch 82 based on a truth table shown in FIG. 11 and then provides a control signal which controls the transfer gates $\mathbf{41}_{1a}$–$\mathbf{41}_{1c}$, $\mathbf{41}_{2a}$–$\mathbf{41}_{2c}$, . . . That is, when the 2-bit data for each dot is 00, not to eject ink, the decoder 83 provides a control signal that turns OFF all the transfer gates 41*a*–41*c* connected to the corresponding piezoelectric actuators 21 and, when the data is 01, to provide a large-sized diameter of ink droplet, it outputs a control signal that turns ON the transfer gates connected to the corresponding piezoelectric actuators 21 and turns OFF the transfer gates 41*b* and 41*c,* and when the data is 10, to provide a medium-sized diameter of ink droplets, it provides a control signal that turns ON the transfer gates 41*b* connected to the corresponding piezoelectric actuators 21 and turns OFF the transfer gates 41*a* and 41*c,* and the data is 11, to provide a small-sized diameter of ink droplets, it provides a control signal that turns ON the transfer gates 41*c* connected to the piezoelectric actuators 21 and turns OFF the transfer gates 41*a* and 41*b.*

As described above, to the piezoelectric actuators 211, 212, . . . which respectively eject ink of four colors of yellow (Y), magenta (M), cyan (C), and black (K) are applied one of the amplification driving waveform signals $S_{PD1}$–$S_{PD3}$ which corresponds to the printing data $D_P$.

Now the operations of the waveform driving circuit 36*a* and the waveform generating circuit 38*a* as well as the corresponding operations of the CPU 31 are described with reference to FIGS. 1, 5, 7, 8, 13, and 14.

Figure 1:
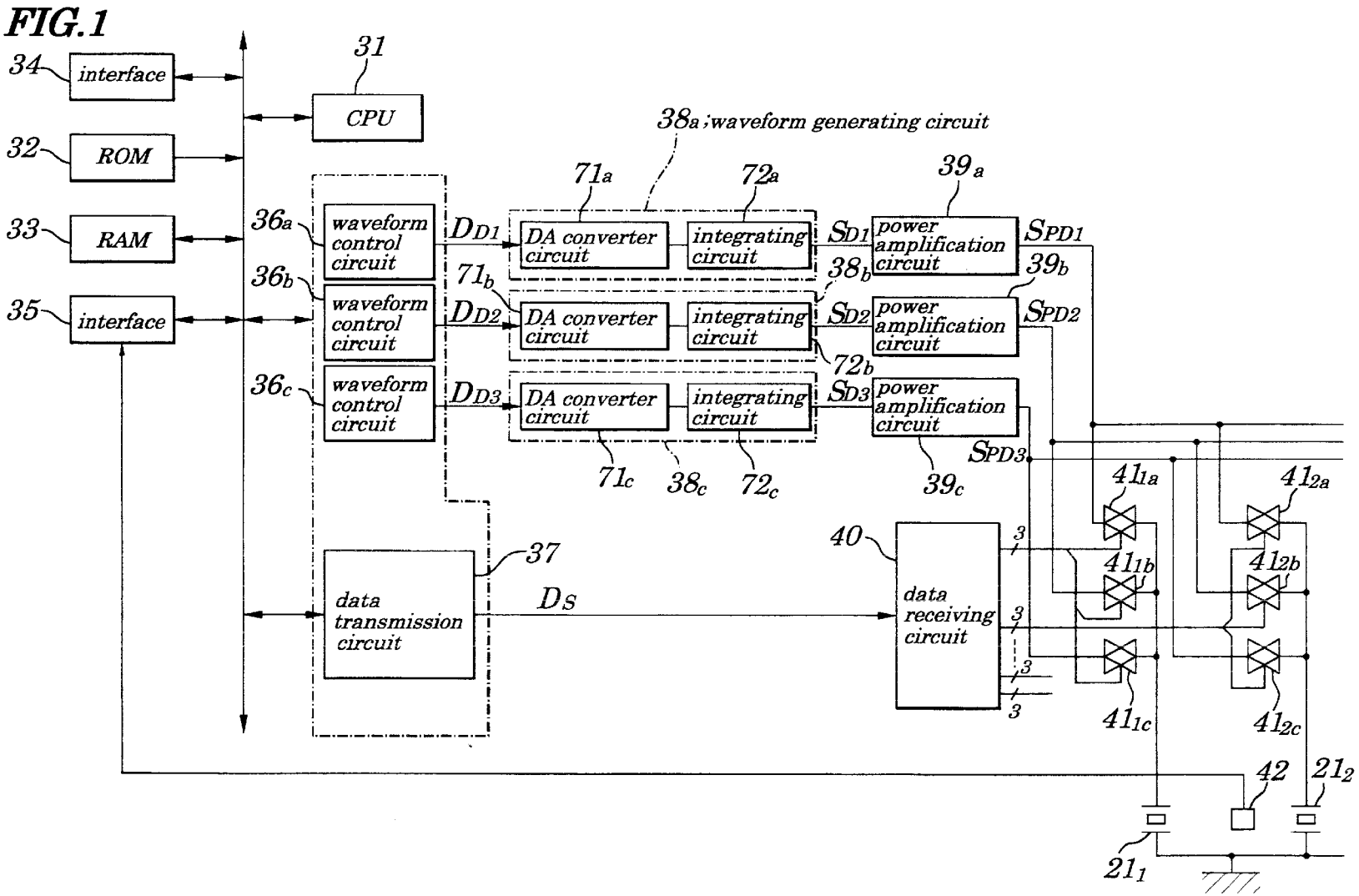
FIG. 1 is a block diagram for showing an electrical configuration of an ink jet printer to which is applied an ink jet head driving circuit according to one embodiment of the present invention.

When power is applied to an ink jet printer shown in FIG. 1, the CPU 31 reads out programs from the ROM 32 and executes them. First the CPU 31 performs initialization processing such as clearing of various registers and flags reserved in the RAM 33 and then reads out the time information pieces $T_1$–$T_5$, and the current information pieces $I_1$–$I_6$ of the driving waveform signal $D_{D1}$ (see (a) of FIG. 13) to eject large-sized ink droplets which are stored in a prescribed storage area of the ROM 32 and then temporarily stores them in the time information registers $\mathbf{51}_1$–$\mathbf{51}_6$ and the current information registers $\mathbf{53}_1$–$\mathbf{53}_6$ respectively and also reads out charge information and discharge information stored in a prescribed area of the ROM 32 and temporarily stores them in the charge register 55 and the discharge register 56 respectively (see FIG. 5).

Note here that in FIG. 7, the bias potential $V_B$ is to be applied when power is applied to the ink jet printer.

Figure 13:
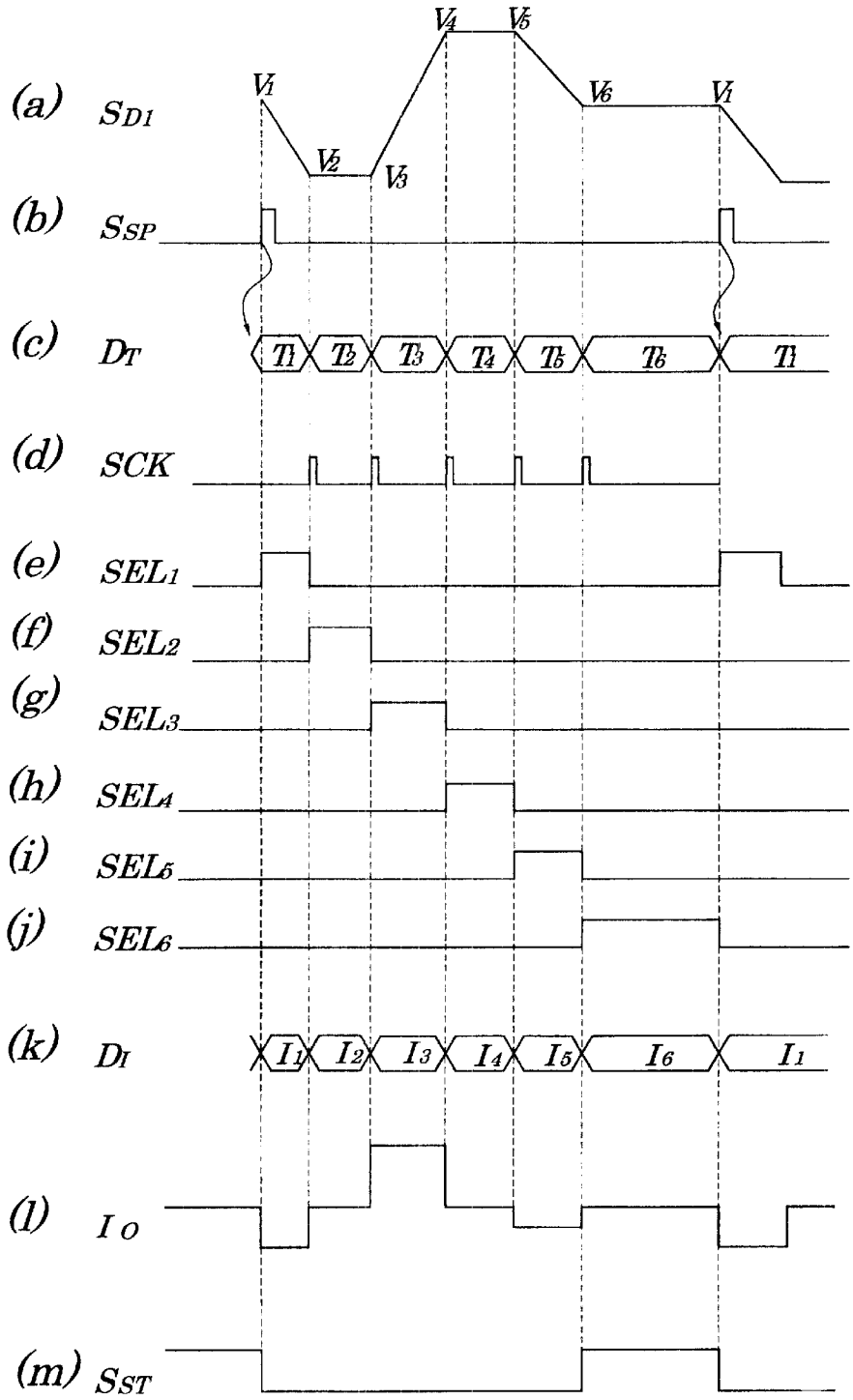
FIG. 13 is a timing chart explaining operations of the same waveform control circuit as above.

Next, before printing is started, that is, immediately before the spacing is activated, the CPU 31 supplied the zero-potential hold signal $S_Z$ of a H-level (see (c) of FIG. 13) and the integration stop signal $S_{ST}$ of a H-level (see (m) of FIG. 13) to the waveform generating circuit (see FIG. 7) and also the Select signal to select 0 for the selector 57 of the waveform control circuit 36*a* shown in FIG. 5.

With this, at the waveform generating circuit 38*a* shown in FIG. 7, the digital/analog converter circuit 71*a* is supplied with a value 0 for analog conversion, in which, however, the output current $I_O$ is zero as can be seen from FIG. 8.

At the same time, the transistor Q3 is turned ON with the H-level zero-potential hold signal $S_Z$, to ground the positive input terminal of the operational amplifier OP3 in order to hold the output voltage $V_{OUT}$ of the operational amplifier OP2 to a zero potential.

Figure 14:
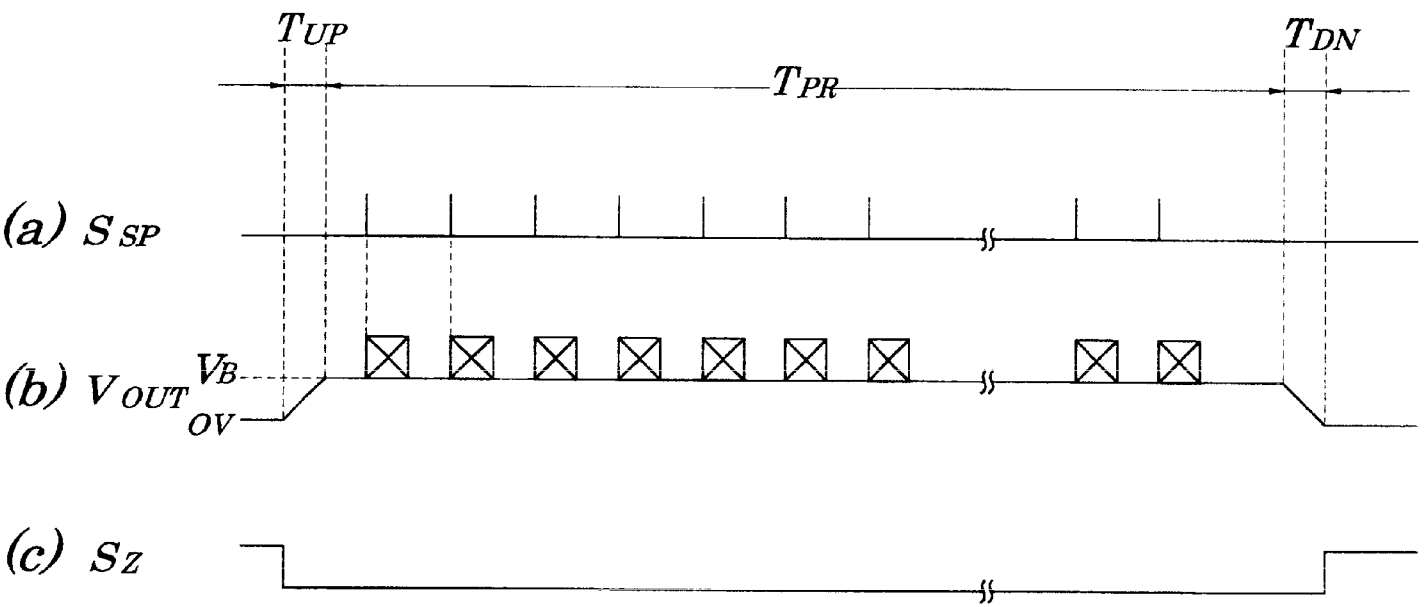
FIG. 14 is a timing chart showing an example of a relationship among an output voltage $V_{OUT}$, a spacing signal $S_{SP}$, a zero-potential hold signal $S_Z$ of the same waveform control circuit as above.
Figure 15:
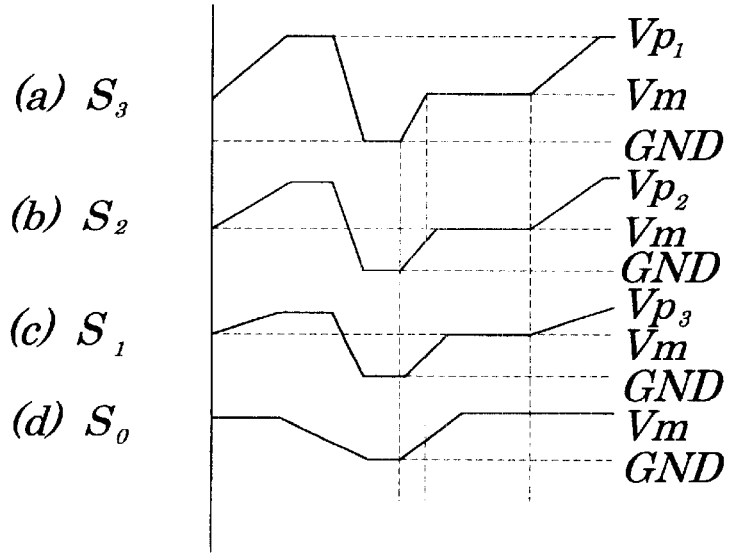
FIG. 15 (PRIOR ART)
FIG. 15 a timing chart showing an example of waveforms of a driving waveform signal generated by a conventional ink jet head driving circuit.

Also, the transistors Q1 and Q2 are turned OFF with the H-level integration stop signal $S_{ST}$ to form a negative feed-back loop made up of the operational amplifier OP3 etc., thereby stopping the integration operations at the operational amplifier OP1 to provide a zero potential of the output voltage $V_{OUT}$ as shown in (b) of FIG. 14.

Then, when printing is started, that is, when spacing is actuated (during a period $T_{UP}$ shown in FIG. 14), the CPU 31, as shown in (c) of FIG. 14, provides the L-level of the zero-potential hold signal $S_Z$ and the L-level of the integration stop signal SST and supplies the Select signal to select charge information supplied to the charge register 55 to the selector 57 of the waveform control circuit 36*a* shown in FIG. 5.

With this, in the waveform generation circuit 38*a,* charge information for charging from a zero potential to the bias potential $V_B$ is supplied to the digital/analog converter circuit 71*a,* to be converted into analog information.

At the same time, by the L-level zero-potential hold signal, the transistor Q3 is turned OFF, thereby applying the bias potential $V_B$ to the positive input terminal of the operational amplifier OP3 to hold the output voltage $V_{OUT}$ of the operational amplifier OP2 to the bias potential $V_B$.

By the L-level integration stop signal $S_{ST}$, however, the transistors Q1 and Q2 are turned ON to cut off a negative feed-back loop made up by the operational amplifier etc. and ground the positive input terminal of the operational amplifier OP1, thereby starting integration operations from a zero potential to the bias potential $V_B$ at the operational amplifier OP1.

The output voltage $V_{OUT}$ of the operational amplifier OP2, therefore, rises from a zero potential to the bias potential $V_B$ when spacing is actuated, as shown in (b) of FIG. 14.

Next, during printing (period $T_{PR}$ in FIG. 14), when the driving waveform signal $S_{D1}$ is not being generated, it is necessary to hold the output voltage of the waveform generation circuit 38*a* to the bias potential $V_B$.

The CPU 31, therefore, provides the H-level of the integration stop signal $S_{ST}$ and also supplies the Select signal to select value 0 at the selector 57 of the waveform control circuit 36*a* shown in FIG. 5. With this, in the waveform generating circuit 38*a* shown in FIG. 7, the value 0 is supplied to the digital/analog converter circuit 71*a,* to be converted into analog information, with the output current $I_O$ being zero.

By the H-level integration stop signal $S_{ST}$, on the other hand, the transistors Q1 and Q2 are turned OFF to form a negative feed-back loop with the operational amplifier OP3 etc., thus stopping integration operations at the operational amplifier OP1 to permit the output voltage $V_{OUT}$ to become the bias potential $V_B$.

If, for example, the output voltage of the operational amplifier OP2 is higher than the bias potential VB, the output voltage $V_f$ of the operational amplifier OP3 has its absolute value amplified as much as by a differential voltage between $V_B$ and $V_{OUT}$ and also a negative sign. Since the output voltage $V_f$ is a few volts or so and, therefore, divided into values of a milli-volt order by the resistors R4 and R5 and then applied to the positive input terminal of the operational amplifier OP1. Consequently, a negative offset voltage is applied to the operational amplifier OP1, to perform such a negative feed-back operation that the output voltage $V_{OUT}$ may be decreased to the bias potential $V_B$.

If, on the other hand, the output voltage $V_{OUT}$ of the operational amplifier OP2 is lower than the bias potential $V_B$, the output voltage $V_f$ of the operational amplifier OP3 has its absolute value amplified as much as by a differential voltage between $V_B$ and $V_{OUT}$. and also has a negative sign and divided in voltage by the resistors R4 and R5 and then applied to the positive input terminal of the operational amplifier OP1.

Consequently, a positive offset voltage is applied to the operational amplifier OP1, to perform such a negative feed-back operation that the output voltage $V_O$ may be increased to the bias potential $V_B$.

When the spacing signal $S_{ST}$ is supplied in such a condition, the CPU 31 provides the L-level of the integration stop signal $S_{ST}$ (see (m) of FIG. 13) and also supplies the Select signal to select current data $D_1$ to be supplied from the selector 54 to the selector 57 of the waveform control circuit 36*a* shown in FIG. 5.

Also, in the waveform control circuit 36*a,* the counter 58 is reset by the spacing signal SSP, to start counting in synchronization with the system clock signal CK, so that the shift register 60 has its bit 0 set to 1 and its bits 1–5 set to 0, that is, only the Select signal $SEL_1$ becomes active as shown in (e)–(j) of FIG. 13. Based on thus activated Select signal $SEL_1$, therefore, the selector 52 selects time information $T_1$ supplied from the time information register $\mathbf{51}_1$ and provides it as time data $D_T$ (see (c) in FIG. 13).

Based on thus activated Select signal $SEL_1$, the selector 54, on the other hand, selects current information I1 supplied. from the current information register 531 and provides it as current data $D_1$ (see (k) in FIG. 13).

With this, in the waveform generating circuit 38*a* shown in FIG. 7, the current information I1 is supplied to the digital/analog converter circuit 71*a* as the current data $D_I$, to be converted into analog information and provided as output current $I_O$ (see (i) of FIG. 13).

By the L-level integration stop signal $S_{ST}$, on the other hand, the transistors Q1 and Q2 are turned ON, to cut off a negative feed-back loop made up of the operational amplifier OP3 etc., thus grounding the positive input terminal of the operational amplifier OP1 to start integration operations at the operational amplifier OP1. The output voltage $V_{OUT}$ of the operational amplifier OP2, therefore, changes from a voltage $V_1$ to a voltage $V_2$ as shown in see (a) of FIG. 13.

When the count value of the counter 58 becomes equal to the time data $D_T$, in this case, the time information $T_1$, the coincidence circuit 59 provides a shift clock signal SCK with the same pulse width as the system clock signal (see FIG. 13D), thereby permitting the shift register 60 to shift its internal data by each bit to the higher-order bit side in synchronization with the shift clock signal SCK.

In this case, 1 is set to bit 1 and bit 0 and bits 2–5 are set to 0, that is, as shown in (e)–(j) of FIG. 13, only the Select signal $SEL_2$ becomes active. The selector 52, therefore, based on thus activated Select signal $SEL_2$, selects time information $T_2$ supplied from the time information register $\mathbf{51}_2$ and provides it as the time data $D_T$ (see (c) of FIG. 13).

Based on thus activated Select signal $SEL_2$, on the other hand, the selector 54 selects current information $I_2$ supplied from the current information register $\mathbf{53}_2$ and provides it as the current information $D_I$ (see (k) of FIG. 13).

With this, in the waveform generating circuit 38*a,* the current information $I_2$ is supplied as the current data DI to the digital/analog converter circuit 71*a,* to be converted into analog information of the output current $I_O$ (see (i) of FIG. 13), thus starting integration operations at the operational amplifier OP1. The output voltage $V_{OUT}$ of the operational amplifier OP2, therefore, changes from a voltage $V_2$ to a voltage $V_3$ as shown in (a) of FIG. 13.

By repeating the above-mentioned operations until the Select signal $SEL_6$ becomes active, the driving waveform signal $S_{D1}$ shown in (a) of FIG. 13 is generated.

After the driving waveform signal $S_{D1}$ is generated, the CPU 31, the waveform control circuit 36*a,* and the waveform generating circuit 38*a* perform the above-mentioned operations to hold the output voltage $V_{OUT}$ of the operational amplifier OP2 at the bias potential $V_B$, until the spacing signal $S_{SP}$ is supplied next time.

During printing (period $T_{PR}$ in FIG. 14), as shown in (b) of FIG. 14, each time the spacing signal $S_{SP}$ is supplied, the generation of the driving waveform signal $D_{D1}$ and the holding of the bias potential $V_B$ are repeated.

Next, when printing is terminated, that is, spacing is terminated (period $T_{DN}$ in FIG. 14), the CPU 31 provides the L-level of the integration stop signal $S_{ST}$ and also supplies the Select signal to the selector 57 of the waveform control circuit 36*a* shown in FIG. 5, to select charge information supplied from the charge register 56.

With this, in the waveform generating circuit 38*a* shown in FIG. 7, discharge information is supplied to the digital/analog converter circuit 71*a* for discharging from the bias potential $V_B$ to a zero potential, to be converted into analog information.

By the L-level integration stop signal $S_{ST}$, on the other hand, the transistors Q1 and Q2 are turned ON to cut off a feed-back loop made up of the operational amplifier OP3 etc., which in turn ground the positive input terminal of the operational amplifier OP1, thus starting integration operations at the operational amplifier OP1 from the bias potential $V_B$ to a zero potential.

The output voltage $V_{OUT}$ of the operational amplifier OP2, therefore, is decreased to a zero potential from the bias potential VB when spacing is terminated, i.e. at the time of $T_{DN}$.

When printing is terminated, the CPU 31 supplies the H-level of the zero-potential hold signal $S_Z$ (see (c) in FIG. 14) to the waveform generating circuit 38*a* (see FIG. 7) and also supplies the Select signal to the selector 57 of the waveform control circuit 36*a* shown in FIG. 5 to select value 0.

With this, in the waveform generating circuit 38*a* shown in FIG. 7, the value 0 is supplied to the digital/analog converter circuit 71*a,* to be converted into analog information, with the output current $I_O$ being zero. By the H-level zero-potential hold signal $S_Z$, on the other hand, the transistor Q3 is turned ON, to ground the positive input terminal of the operational amplifier OP3 in order to hold the output voltage $V_{OUT}$ of the operational amplifier OP2 to a zero potential. With this, as shown in (b) of FIG. 14, the output voltage $V_{OUT}$ becomes zero in potential again.

The description of the operations of the waveform control circuits 36*b* and 36*c* and the waveform generating circuits 38*b* and 38*c* as well as those after the corresponding initialization processing of the CPU 31 is omitted because it is the same as that of the operations of the above-mentioned waveform control circuit 36*a* and the waveform generating circuit 38*a* and those after the corresponding initialization processing of the CPU 31, except that the driving waveform signals to be generated are the driving waveform signal $S_{D2}$ for a medium-sized diameter of ink droplets and the driving waveform signal $S_{D3}$ for a small-sized diameter of ink droplets respectively and the number and the value of the time information and the current information are different.

Next, with reference to FIG. 9, the operations of the power amplification circuit 39*a* are described.

The driving waveform signal $S_{D1}$ supplied from the waveform generating circuit 38*a* is differential-amplified by a differential amplifier made up of the transistors Q1 and Q2 and the resistors R11 and R12 and then voltage-amplified by a voltage amplifier made up of the transistor Q15 and the resistor R14.

Then, the output signal of the voltage amplifier passes through a buffer made up of the transistors Q17 and Q18 and the transistors R18 and 19 and then is current-amplified by an SEPP-type current amplifier, made up of the transistors Q19 ad Q20 and the resistors 20–23, connected in a source-follower configuration and provided as an amplified driving waveform signal $S_{PD1}$.

Figure 16:
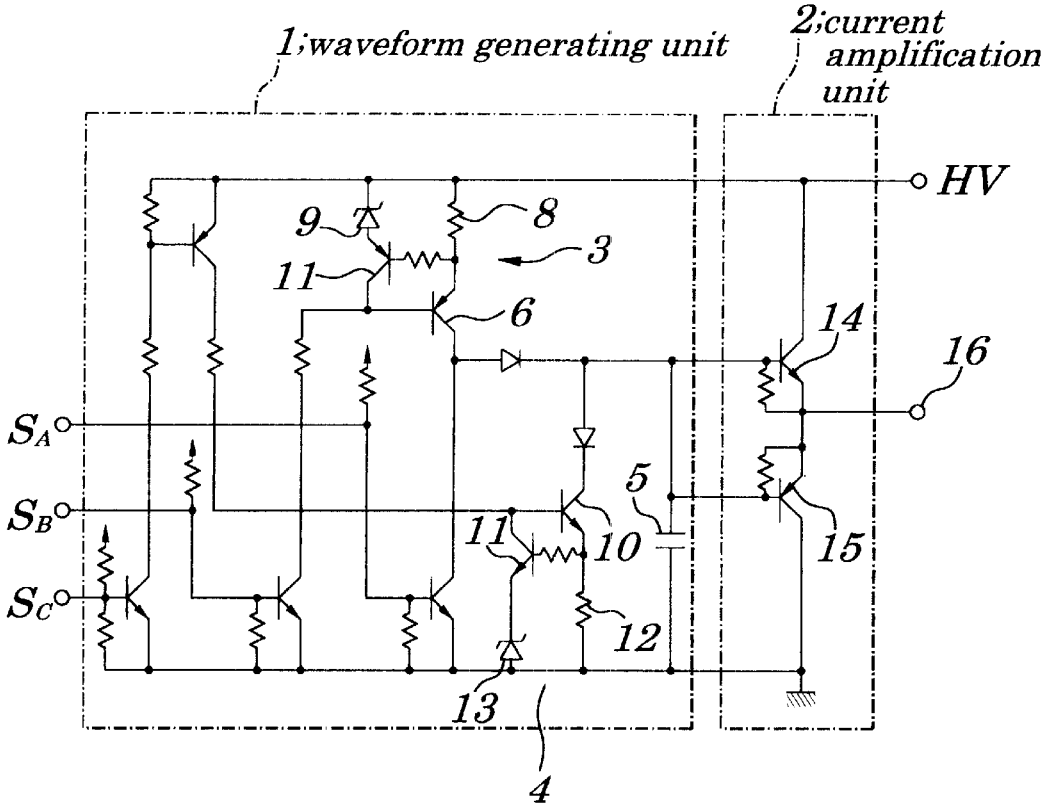
FIG. 16 (PRIOR ART)
FIG. 16 is a circuit diagram showing an electrical configuration of a common waveform generating means constituting the conventional ink jet head driving circuit.
Figure 17:
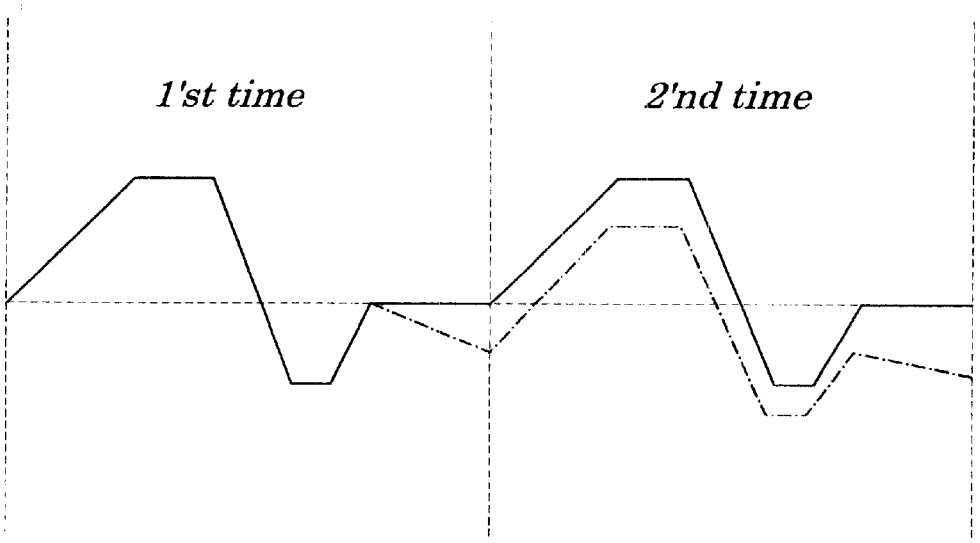
FIG. 17 (PRIOR ART)
FIG. 17 a view for showing disadvantages of the conventional ink jet head driving circuit.

Since the resistors R24 and R25 and the capacitor C11 configure a negative feed-back circuit from the current amplifier to the differential amplifier, as compared to the conventional SEPP-type current amplifier 2 such as shown in FIG. 16, it can have a frequency band expanded up to about 1 MHz even if with a capacitive load such as piezoelectric actuators.

Therefore, even when a driving waveform signal $S_{D3}$ with a high voltage slew-rate (dV/dt) such as shown in FIG. 3C is supplied as against a large capactive load such as stacked-layer type piezoelectric actuators etc., those stacked-layer type piezoelectric actuators etc. can be driven. Moreover, the capacitor C11 has a reduced amplification factor in the high-frequency band, so that it is possible to prevent oscillation in the case where a large capacitive load such as stacked-layer type piezoelectric actuators is driven. With this, the reliability is improved.

The description of the operations of the power amplification circuits 39*a* and 39*c* is omitted here because those operations are the same as those of the above-mentioned power amplification circuit 39*a* except that the driving waveform signals to be power-amplified are the driving waveform signals $S_{D2}$ and $S_{D3}$ respectively supplied from the waveform generating circuits 38*b* and 38*c*.

Thus, this exemplified configuration has the waveform control circuits 36*a*–36*c* and the data transmission circuit 37 in digital circuits easy to integrate and also has ASICs, thus integrating the circuits, even if complicated, into one LSI chip to reduce the costs and the packaging area and improve the security.

Also, since this exemplified configuration realizes the waveform generating circuit 38 using the digital/analog converter DAC and inexpensive operational amplifiers OP's, the voltage applied to the capacitor C1 for use in integration operations is 5V or less and also even driving waveform signals with a high voltage slew-rate (dV/dt) can be easily produced with inexpensive elements.

Also, by using operational amplifiers OP's, virtual grounding can be utilized to provide the same path for charging and discharging. With this, therefore, the number of elements used can be reduced.

Moreover, according to this exemplified configuration, in the waveform generating circuit 38, the operational amplifier OP1 which acts as an integrator is used to hold a zero potential or the bias potential $V_B$ and, at the same time, the operational amplifier OP3 and other circuit elements are used to give a negative feed-back, so that the output voltage $V_{OUT}$ can be held at a constant value of the bias potential $V_B$.

With this, it is possible to prevent malfunctions such as disabled or improper ejection of ink droplets. This leads to improvements in reliabilities.

It is apparent that the present invention is not limited to the above embodiments but may be changed and modified without departing from the scope and spirit of the invention.

For example, the number of gradations are not limited to four but may be increased or decreased as occasion demands. Also, the ink colors is not limited to yellow (Y), magenta (M), cyan (c), and black (K) but may be increased or decreased as necessary. The number of nozzles is also arbitrary.

Although the above-mentioned embodiments have shown examples where the driving waveform information of the driving waveform signals $S_{D1}$–$S_{D3}$ has time information pieces $T_1$–$T_6$ and current information pieces $I_1$–$I_6$, the driving waveform information may comprise time information pieces $T_1$–$T_6$ and voltage information pieces $V_1$–$V_6$ or gradient information which indicates the gradient of the waveforms.

Also, although the above-mentioned embodiments have shown examples where the driving waveform signals $S_{D1}$–$S_{D3}$ have trapezoidal waveforms having flat portions, the signals may be triangular waveforms without flat portions. When the ink droplet diameter is small in particular, steep waveforms, even when triangular, are preferred. That is, the extreme of the trapezoidal waveform may be a triangular waveform.

As for the number of change points in the leading edge and the trailing edge of each of the driving waveform signals $S_{D1}$–$S_{D3}$, it is not necessary to limits that number to six to eight but that number may be larger or smaller.

However, the number of the time information registers 51 and the current information registers needs to be increased or decreased according to the number of change points, because that number corresponds to the number of the above-mentioned change points.

Also, as shown in FIG. 1, temperature sensors 42 may be provided near the piezoelectric actuators $\mathbf{21}_1$, $\mathbf{21}_2$, . . . and have their own temperature signals entered to these actuators via an interface 35, and the driving waveform information for each temperature value is beforehand stored in prescribed areas of the ROM 32 so that the CPU 31 may reads out the driving waveform information from the ROM 32 in response to the temperature signals and supplies that information to the waveform control circuits 36*a*–36*c*. According to such a configuration, ink droplets can be ejected in a stable manner irrespective of changes in the viscosity of ink due to changes in the temperature of the ink jet heads.

Also, although the above-mentioned embodiments have shown examples where the waveform control circuit 36 reads out from the ROM 32 both time information and current information once into the time information register 51 or the current information register 53, the possible embodiments are not limited to these.

Such a configuration may also be possible that only the time information is once read out into the time information register 51 and, when the coincidence circuit detects a match between the counter 58's count value and the time information, reads out the current information from the prescribed area of the ROM 32.

Also, although the above-mentioned embodiments have shown examples where the current amplifier configuring the power amplification circuit 39 is given by connecting the MOSFET-type transistors Q19 and Q20 in an SEPP-type source-follower configuration, the possible embodiments are not limited to these, so that the current amplifier may be configured by NPN-type transistors and PNP-type transistors connected in an SEPP-type emitter follower configuration.

It is thus apparent that the present invention is not limited to the above embodiments but may be changed and modified without departing from the scope and sprit of the invention.

Finally, the present application claims the priority based on Japanese Patent Application No. Hei10-318445 filed on Oct. 20, 1998, which is herein incorporated by reference.

What is claimed is:

1. A driving circuit for ink jet printing head which comprises at least one nozzle and at least one pressure producing chamber and which, when printing, applies a driving waveform signal to at least one piezoelectric actuator provided at a position corresponding to said pressure producing chamber to rapidly change a volume of said pressure producing chamber filled with ink, thereby ejecting ink droplets from said nozzle, further comprising:

storage means for storing driving waveform information for each diameter of said ink droplets;

a plurality of waveform control means which is provided for each diameter of said ink droplets and which reads out and then sequentially outputs corresponding said driving waveform information;

a plurality of waveform generating means which is provided for each diameter of said ink droplets, for generating respectively corresponding driving waveform signals, each of which has a trapezoidal waveform or a triangular waveform, by converting driving waveform information provided sequentially from said waveform control means into analog information and then by conducting an integration operation on said converted analog information;

driving means which selects one driving waveform signal of a plurality of driving waveform signals output from said plurality of waveform generating means and applies said one driving waveform signal to said piezoelectric actuator; and wherein each waveform generating means comprises a digital/analog converter which converts said voltage information or said current information into an analog signal, an integrator which comprises an operational amplifier and an integrating capacitor to perform integration operations on said analog signal, a negative feed-back unit which gives a negative feed-back to said operational amplifier so as to hold an output voltage of said waveform generating means to a zero potential before stating of and after termination of printing and to a prescribed bias potential which provides a reference of contraction and expansion of said piezoelectric actuator at a time point of not printing during printing operations, and a negative feed-back cut-off unit which cuts off said negative feed-back to ground a positive input terminal of said operational amplifier.

2. A driving circuit for ink jet printing head which comprises at least one nozzle and at least one pressure producing chamber and which, when printing, applies a driving waveform signal to at least one piezoelectric actuator provided at a position corresponding to said pressure producing chamber to rapidly change a volume of said pressure producing chamber filled with ink, thereby ejecting ink droplets from said nozzle, further comprising:

storage means for storing driving waveform information for each diameter of said ink droplets;

a plurality of waveform control means which is provided for each diameter of said ink droplets and which reads out and then sequentially outputs corresponding said driving waveform information;

a plurality of waveform generating means which is provided for each diameter of said ink droplets, for generating respectively corresponding driving waveform signals, each of which has a trapezoidal waveform or a triangular waveform, by converting driving waveform information provided sequentially from said waveform control means into analog information and then by conducting an integration operation on said converted analog information;

driving means which selects one driving waveform signal of a plurality of driving waveform signals output from said plurality of waveform generating means and applies said one driving waveform signal to said piezoelectric actuator;

a plurality of power amplification means which is provided for each diameter of said ink droplets, for power-amplifying driving waveform signals output from corresponding waveform generating means and for supplying said signal to said driving means, and wherein each power amplification means comprises a differential amplification means which differential-amplifies corresponding driving waveform signals, a voltage amplification unit which voltage-amplifies an output signal of said differential amplification unit, a single-ended push-pull type current amplification unit which current-amplifies an output signal of said voltage amplification unit, and a negative feed-back unit which gives a negative feed-back to said differential amplification unit from said current amplification unit.

3. A driving circuit for ink jet printing head which comprises at least one nozzle and at least one pressure producing chamber and which, when printing, applies a driving waveform signal to at least one piezoelectric actuator provided at a position corresponding to said pressure producing chamber to rapidly change a volume of said pressure producing chamber filled with ink, thereby ejecting ink droplets from said nozzle, further comprising:

storage means for storing driving waveform information for each diameter of said ink droplets;

a plurality of waveform control means which is provided for each diameter of said ink droplets and which reads out and then sequentially outputs corresponding said driving waveform information;

a plurality of waveform generating means which is provided for each diameter of said ink droplets, for generating respectively corresponding driving waveform signals, each of which has a trapezoidal waveform or a triangular waveform, by converting driving waveform information provided sequentially from said waveform control means into analog information and then by conducting an integration operation on said converted analog information;

driving means which selects one driving waveform signal of a plurality of driving waveform signals output from said plurality of waveform generating means and applies said one driving waveform signal to said piezoelectric actuator;

wherein said driving means comprises a data transmission unit, a data receiving unit, and a plurality of transfer gates provided for each diameter of said ink droplets for each piezoelectric actuator, wherein said data transmission unit sends at least gradation information of printing data to said data receiving unit, and wherein said data receiving unit is provided together with said plurality of transfer gates near said piezoelectric actuators, to turn corresponding transfer gates ON or OFF based on gradation information sent from said data transmission unit.

4. The driving circuit for ink jet printing head according to claim 3, wherein at least said plurality of waveform control means and said data transmission unit are integrated into one unit.

5. A driving circuit for ink jet printing head which comprises at least one nozzle and at least one pressure producing chamber and which, when printing, applies a driving waveform signal to at least one piezoelectric actuator provided at a position corresponding to said pressure producing chamber to rapidly change a volume of said pressure producing chamber filled with ink, thereby ejecting ink droplets from said nozzle, further comprising:

storage means for storing driving waveform information for each diameter of said ink droplets;

a plurality of waveform control means which is provided for each diameter of said ink droplets and which reads out and then sequentially outputs corresponding said driving waveform information;

a plurality of waveform generating means which is provided for each diameter of said ink droplets, for generating respectively corresponding driving waveform signals, each of which has a trapezoidal waveform or a triangular waveform, by converting driving waveform information provided sequentially from said waveform control means into analog information and then by conducting an integration operation on said converted analog information;

driving means which selects one driving waveform signal of a plurality of driving waveform signals output from said plurality of waveform generating means and applies said one driving waveform signal to said piezoelectric actuator;

wherein said driving waveform information comprises time information about time of change point of corresponding driving waveform signals and voltage information about voltage of said change point or current information which is a differential value of said voltage information in terms of time, wherein each waveform control means sequentially outputs said voltage information or said current information according to said time information; and wherein each waveform generating means comprises a digital/analog converter which converts said voltage information or said current information into an analog signal, an integrator which comprises an operational amplifier and an integrating capacitor to perform integration operations on said analog signal, a negative feed-back unit which gives a negative feed-back to said operational amplifier so as to hold an output voltage of said waveform generating means to a zero potential before stating of and after termination of printing and to a prescribed bias potential which provides a reference of contraction and expansion of said piezoelectric actuator at time point of not printing during printing operations, and a negative feed-back cut-off unit which cuts off said negative feed-back to ground a positive input terminal of said operational amplifier.

6. A driving circuit for ink jet printing head which comprises at least one nozzle and at least one pressure producing chamber and which, when printing, applies a driving waveform signal to at least one piezoelectric actuator provided at a position corresponding to said pressure producing chamber to rapidly change a volume of said pressure producing chamber filled with ink, thereby ejecting ink droplets from said nozzle, further comprising:

storage means for storing driving waveform information for each diameter of said ink droplets;

a plurality of waveform control means which is provided for each diameter of said ink droplets and which reads out and then sequentially outputs corresponding said driving waveform information;

a plurality of waveform generating means which is provided for each diameter of said ink droplets, for generating respectively corresponding driving waveform signals, each of which has a trapezoidal waveform or a triangular waveform, by converting driving waveform information provided sequentially from said waveform control means into analog information and then by conducting an integration operation on said converted analog information;

driving means which selects one driving waveform signal of a plurality of driving waveform signals output from said plurality of waveform generating means and applies said one driving waveform signal to said piezoelectric actuator;

wherein said driving waveform information comprises time information about time of change point of corresponding driving waveform signals and voltage information about voltage of said change point or current information which is a differential value of said voltage information in terms of time, wherein each waveform control means sequentially outputs said voltage information or said current information according to said time information, a plurality of power amplification means which is provided for each diameter of said ink droplets, for power-amplifying driving waveform signals output from corresponding waveform generating means and for supplying said signal to said driving means, and wherein each power amplification means comprises a differential amplification means which differential-amplifies corresponding driving waveform signals, a voltage amplification unit which voltage-amplifies an output signal of said differential amplification unit, a single-ended push-pull type current amplification unit which current-amplifies an output signal of said voltage amplification unit, and a negative feed-back unit which gives a negative feed-back to said differential amplification unit from said current amplification unit.

7. A driving circuit for ink jet printing head which comprises at least one nozzle and at least one pressure producing chamber and which, when printing, applies a driving waveform signal to at least one piezoelectric actuator provided at a position corresponding to said pressure producing chamber to rapidly change a volume of said pressure producing chamber filled with ink, thereby ejecting ink droplets from said nozzle, further comprising:

storage means for storing driving waveform information for each diameter of said ink droplets;

a plurality of waveform control means which is provided for each diameter of said ink droplets and which reads out and then sequentially outputs corresponding said driving waveform information;

a plurality of waveform generating means which is provided for each diameter of said ink droplets, for generating respectively corresponding driving waveform signals, each of which has a trapezoidal waveform or a triangular waveform, by converting driving waveform information provided sequentially from said waveform control means into analog information and then by conducting an integration operation on said converted analog information; and driving means which selects one driving waveform signal of a plurality of driving waveform signals output from said plurality of waveform generating means and applies said one driving waveform signal to said piezoelectric actuator;

wherein said driving waveform information comprises time information about time of change point of corresponding driving waveform signals and voltage information about voltage of said change point or current information which is a differential value of said voltage information in terms of time, wherein each waveform control means sequentially outputs said voltage information or said current information according to said time information;

wherein said driving means comprises a data transmission unit, a data receiving unit, and a plurality of transfer gates provided for each diameter of said ink droplets for each piezoelectric actuator, wherein said data transmission unit sends at least gradation information of printing data to said data receiving unit, and wherein said data receiving unit is provided together with said plurality of transfer gates near said piezoelectric actuators, to turn corresponding transfer gates ON or OFF based on gradation information sent from said data transmission unit.

8. The driving circuit for ink jet printing head according to claim 7, wherein at least said plurality of waveform control means and said data transmission unit are integrated into one unit.

* * * * *